US007665930B2

(12) United States Patent
Kennedy et al.

(10) Patent No.: US 7,665,930 B2
(45) Date of Patent: Feb. 23, 2010

(54) HYDRAULICALLY POWERED DOOR AND SYSTEMS FOR OPERATING SAME IN LOW-TEMPERATURE ENVIRONMENTS

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 420 days.

(21) Appl. No.: 11/735,833

(22) Filed: Apr. 16, 2007

(65) Prior Publication Data

US 2008/0253841 A1 Oct. 16, 2008

(51) Int. Cl.
*E05F 15/00* (2006.01)
*E21D 9/06* (2006.01)

(52) U.S. Cl. ..... 405/144; 405/132; 49/339; 49/340

(58) Field of Classification Search ..... 405/144; 299/12; 49/339, 340, 344, 345
See application file for complete search history.

(56) References Cited

U.S. PATENT DOCUMENTS

| | | | | | |
|---|---|---|---|---|---|
| 2,764,147 | A | * | 9/1956 | Brunner | 126/247 |
| 3,530,958 | A | | 9/1970 | Brannon et al. | |
| 4,082,331 | A | | 4/1978 | Kennedy et al. | |
| 4,118,894 | A | | 10/1978 | Kennedy et al. | |
| 4,162,718 | A | * | 7/1979 | Lamprey | 187/285 |
| 4,373,294 | A | | 2/1983 | Kennedy et al. | |
| 4,478,535 | A | | 10/1984 | Kennedy et al. | |
| 4,523,406 | A | | 6/1985 | Kennedy et al. | |
| 4,785,915 | A | | 11/1988 | Shah et al. | |
| 4,911,577 | A | | 3/1990 | Kennedy et al. | |
| 5,118,259 | A | | 6/1992 | Bishoff | |
| 5,168,667 | A | | 12/1992 | Kennedy et al. | |
| 5,240,349 | A | | 8/1993 | Kennedy et al. | |
| 5,971,068 | A | * | 10/1999 | Ochiai et al. | 165/290 |
| 6,032,986 | A | | 3/2000 | Kennedy et al. | |
| 6,164,871 | A | | 12/2000 | Kennedy et al. | |
| 6,425,820 | B1 | | 7/2002 | Kennedy et al. | |
| 6,594,954 | B1 | | 7/2003 | Kennedy et al. | |
| 6,938,372 | B2 | | 9/2005 | Kennedy et al. | |
| 6,955,594 | B2 | | 10/2005 | Kennedy et al. | |
| 2003/0079423 | A1 | | 5/2003 | Kennedy et al. | |
| 2005/0099020 | A1 | | 5/2005 | Kennedy et al. | |

* cited by examiner

*Primary Examiner*—David J. Bagnell
*Assistant Examiner*—Benjamin Fiorello
(74) *Attorney, Agent, or Firm*—Senniger Powers LLP

(57) ABSTRACT

A hydraulic system has a hydraulic actuator for moving a door leaf of a door installation between open and closed positions thereof. A reservoir has a volume for containing a hydraulic fluid. A fluid circuit provides fluid communication between the hydraulic actuator and the reservoir. The system also has a pump for pumping hydraulic fluid from the reservoir into the fluid circuit to operate the actuator. A fluid circuit flushing system of the hydraulic system operates to flush a volume of hydraulic fluid from the fluid circuit back to the reservoir without moving any door leaves of the door installation. The hydraulic system may be part of a mine door installation installed in a mine passageway and having at least one door leaf. The hydraulic actuator is connected to the door leaf for driving movement of the door leaf between its open and closed positions.

18 Claims, 18 Drawing Sheets

HYDRAULICALLY POWERED DOOR AND SYSTEMS FOR OPERATING SAME IN LOW-TEMPERATURE ENVIRONMENTS

FIELD OF THE INVENTION

The present invention is related to hydraulically powered doors in general, and in particular to systems for operating hydraulically powered mine doors in cold temperatures.

BACKGROUND

Mine doors operate under conditions not usually encountered by ordinary doors. A mine door leaf can be subjected to large forces due at least in part to air flow in the mine and consequent air pressure differentials on opposite sides of the door leaf. Mine door leaves can be as large as twenty feet wide and twenty feet high or even larger. Because of their large size, even small pressure differentials result in large forces acting on the door leaves. Mine door leaves have to be sufficiently robust in construction to withstand these large forces. This means that the door leaves tend to be fairly heavy. For example, a door leaf constructed for operation with a pressure differential of twenty inches water gauge may weigh up to two thousand pounds.

The weight of the door leaves in combination with the forces generated by air pressure differentials in the mine makes it difficult to control movement of the door leaves during opening and closing of the door. Likewise, it can be difficult to start the opening movement and complete closing movement of the door leaves. Thus, it is desirable for the opening and closing of the mine doors to be powered by one or more fluid-driven actuators. Hydraulic actuators offer some advantages over pneumatic actuators because the hydraulic fluid is substantially incompressible, making hydraulically-controlled mine doors less susceptible to door leaf runaway.

Mine doors are sometimes installed in relatively cold environments. For example, mines using forced air ventilation systems require doors to be positioned at openings from the surface into the mine to make sure that the air forced into the mine flows through the mine to the intended exhaust outlets rather than back out of the mine through an opening near the forced air inlet. Doors at the openings into the mine may be subjected to cold temperatures (e.g., as low as −50 degrees Fahrenheit) from time to time. Cold temperatures present a problem for operation of hydraulically powered mine doors because the hydraulic fluids used to operate the doors have substantially increased viscosities at these cold temperatures, making the hydraulic fluids too stiff to operate as desired. The lower limit of an acceptable temperature range for a hydraulic fluid varies depending on the characteristics of the particular fluid used in a hydraulic system. Fire-resistant hydraulic fluids, which are required for some mining environments, are particularly susceptible to this problem. However, non-fire resistant hydraulic fluids are also susceptible to cold temperatures.

One partial solution to the problem is to use a tank heater to heat the hydraulic fluid in the reservoir. Unfortunately, this solution does not adequately address all aspects of the problem because the fluid in the hydraulic fluid lines can also be cooled by exposure of the fluid lines to the cold. Further, some hydraulic mine door installations have long hydraulic fluid lines. For example, a single pump may be used to operate the hydraulic actuators for two (or more) different doors in an airlock, as described in more detail in U.S. Pat. No. 6,425,820, the contents of which are hereby incorporated by reference. Moreover, the doors in a mine airlock are often several hundred feet (or more) apart from one another to allow long trains and/or caravans of vehicles to pass through the air lock. Thus, long hydraulic fluid lines are needed to connect the pump to the various doors.

Because of the long fluid lines, a significant amount of hydraulic fluid is contained in the fluid lines (where it receives substantially no heating from the tank heater) rather than in the heated reservoir. Further, the difficulty of moving cold stiff hydraulic fluid through the fluid lines is exacerbated because the long lengths of the fluid lines are associated with a substantial resistance to flow that is independent of the increased viscosity of the hydraulic fluid therein.

Thus, there is a need for hydraulic door installations in general and hydraulic systems for operating doors that facilitate operation thereof in cold environments.

SUMMARY

One aspect of the invention is a mine door installation. The installation includes one or more door frames installed in a mine passageway and one or more door leaves mounted on the door frames for movement between open and closed positions of the respective door leaf. Movement of the one or more door leafs between its open and closed positions is powered by a hydraulic system. The hydraulic system includes a hydraulic actuator connected to one of the door leaves for driving movement thereof between open and closed positions of the door leaf. A reservoir of the hydraulic system has a volume for containing a hydraulic fluid used to operate the hydraulic actuator. A fluid circuit provides fluid communication between the at least one hydraulic actuator and the reservoir. The hydraulic system also includes a pump operable to pump hydraulic fluid from the reservoir into the fluid circuit. Further, the hydraulic system includes a fluid circuit flushing system operable to flush hydraulic fluid from the fluid circuit into the reservoir without moving any of the door leaves of the door installation.

Another aspect of the invention is a hydraulic system for operating a hydraulically powered door installation having one or more door frames and or more door leaves mounted on said one or more door frames for movement between open and closed positions of the respective door leaf. The hydraulic system includes a hydraulic actuator for moving one of the door leaves between its open and closed positions. A reservoir has a volume for containing a hydraulic fluid used to operate the hydraulic actuator. An electrical resistance heater is in thermal communication with the volume of the reservoir for heating the hydraulic fluid in the reservoir. A fluid circuit provides fluid communication between the hydraulic actuator and the reservoir. The hydraulic system also includes a pump for pumping hydraulic fluid from the reservoir into the fluid circuit. A fluid circuit flushing system is operable to flush hydraulic fluid from the fluid circuit into the reservoir without moving any door leaves of the door installation.

Still another aspect of the invention is a hydraulic system for operating a hydraulically powered door installation having one or more door frames and or more door leaves mounted on said one or more door frames for movement between open and closed positions of the respective door leaf. The hydraulic system includes a hydraulic actuator for moving one of the door leaves between its open and closed positions. A reservoir has a volume for containing a hydraulic fluid used to operate the hydraulic actuator. A heater is in thermal communication with the volume of the reservoir for heating the hydraulic fluid in the reservoir. The hydraulic system also includes a fluid circuit providing fluid communication between the at least one hydraulic actuator and the reservoir and a pump for pumping hydraulic fluid from the reservoir into the fluid circuit. A fluid circuit flushing system is operable to flush a volume of hydraulic fluid from the fluid circuit without moving any of the one or more door leaves of the door installation. The volume of hydraulic fluid that is flushed from the fluid circuit is at least about 50 percent of a total volume of hydraulic fluid contained in the fluid circuit.

Still another aspect of the invention is a hydraulic system for operating a hydraulically powered door installation having one or more door frames and or more door leaves mounted the one or more door frames for movement between open and closed positions of the respective door leaf. The hydraulic system includes a hydraulic actuator for moving one of the door leaves between its open and closed positions. A reservoir has a volume for containing a hydraulic fluid used to operate the hydraulic actuator. A fluid circuit provides fluid communication between the at least one hydraulic actuator and the reservoir. The hydraulic system also includes a pump for pumping hydraulic fluid from the reservoir into the fluid circuit. A fluid circuit flushing system of the hydraulic system includes a bypass valve moveable between a working position in which fluid can be pumped into the fluid circuit to operate the hydraulic actuator and a bypass position in which fluid can be pumped into the fluid circuit to flush hydraulic fluid from the fluid circuit without operating the actuator. The fluid circuit is arranged so the shortest path through the fluid circuit between the bypass valve and the reservoir is at least about 15 meters.

Another aspect of the invention is a hydraulic system for operating a hydraulically powered door installation having two or more door frames and two or more door leaves with a first door leaf mounted on a first door frame for movement between its open and closed positions and a second door leaf mounted on a second one of the door frames for movement between its open and closed positions. The hydraulic system includes a first hydraulic actuator for moving the first door leaf between its open and closed positions and a second hydraulic actuator for moving the second door leaf between its open and closed positions. A reservoir has a volume for containing a hydraulic fluid used to operate the first and second hydraulic actuators. A fluid circuit provides fluid communication between the first and second hydraulic actuators and the reservoir. The hydraulic system also includes a pump for pumping hydraulic fluid from the reservoir into the fluid circuit. A fluid circuit flushing system is operable to flush hydraulic fluid from the fluid circuit into the reservoir without moving any of the door leaves. The fluid circuit includes first and second fluid sub-circuits. The first fluid sub-circuit is associated with operation of the first hydraulic actuator and not involved with operation of the second hydraulic actuator. The second fluid sub-circuit is associated with operation of the second hydraulic actuator and not involved with operation of the first hydraulic actuator. The fluid circuit flushing system includes first and second bypass valves in the fluid circuit. The first bypass valve is moveable from a working position in which fluid can be pumped into the fluid circuit to operate the first hydraulic actuator and a bypass position in which fluid can be pumped into the fluid circuit to flush hydraulic fluid from a portion of the first fluid sub-circuit without moving the first door leaf. The second bypass valve is moveable from a working position in which fluid can be pumped into the fluid circuit to operate the second hydraulic actuator and a bypass position in which fluid can be pumped into the fluid circuit to flush hydraulic fluid from a portion of the second fluid sub-circuit without moving the second door leaf.

Another aspect of the invention is a method of operating a hydraulically powered door installation in a cold environment. The door installation has one or more door frames and one or more door leaves mounted thereon for movement between open and closed positions of the door leaves. The hydraulic system includes one or more hydraulic actuators, each of which is connected to one of the one or more door leaves for driving movement of the door leaf between its open and closed positions. A reservoir contains a hydraulic fluid used to operate the one or more hydraulic actuators and a fluid circuit provides fluid communication between the reservoir and the hydraulic actuators. The method includes the step of flushing hydraulic fluid that has cooled in the fluid circuit from the fluid circuit into the reservoir by pumping relatively warmer hydraulic fluid from the reservoir into the fluid circuit without operating any of the hydraulic actuators.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

Corresponding reference characters indicate corresponding parts throughout the drawings.

DETAILED DESCRIPTION

Figure 1:
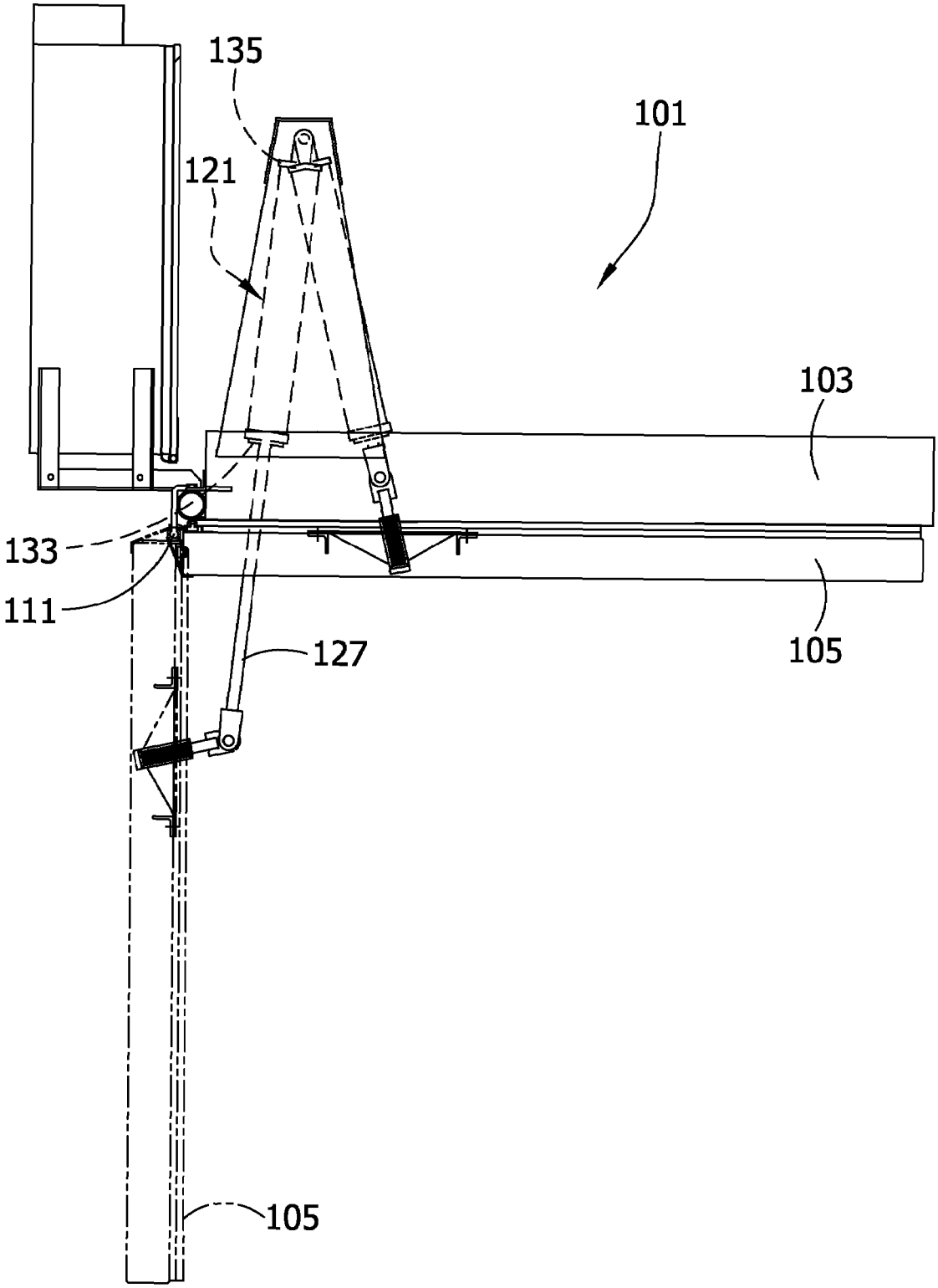
FIG. 1 is a plan view of one embodiment of a single leaf door installation of the present invention.
Figure 2:
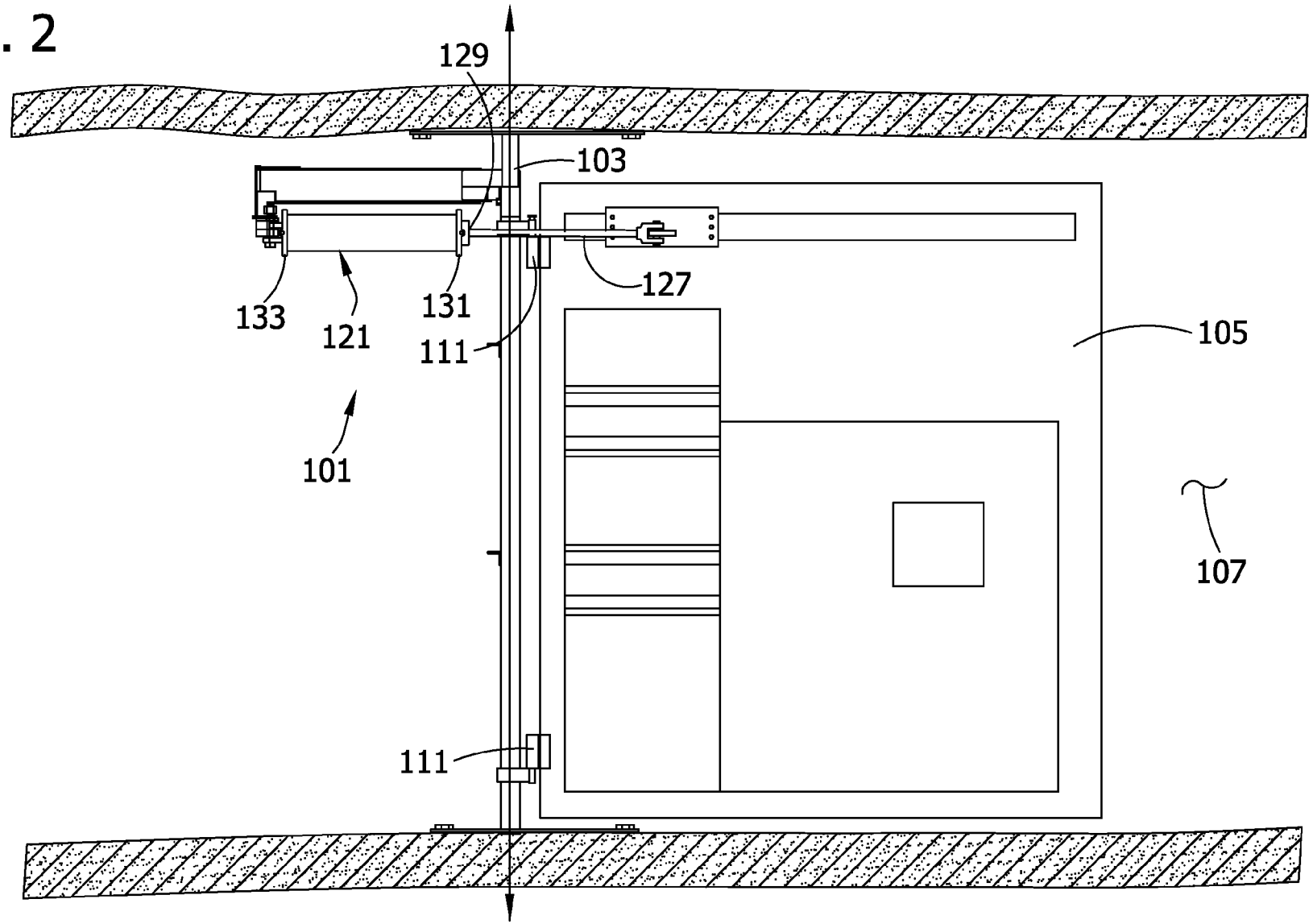
FIG. 2 is a front view of the single leaf door installation illustrated in FIG. 1.

Referring now to the drawings, FIGS. 1 and 2 illustrate one embodiment of a hydraulically powered door installation of the present invention, generally designated 101. The door installation 101 has one or more door frames and one or more door leaves mounted on the door frames for movement between open and closed positions of the respective door leaves. The door installation 101 depicted in FIGS. 1 and 2, for example, is a single leaf door installation, which has a single door frame 103 and a single door leaf 105 mounted on the door frame for movement between its open and closed positions. The door leaf 105 is mounted on the door frame 103 by a hinge connection 111 allowing the door leaf to pivot relative to the door frame between its closed position (shown FIG. 1) and its open position (shown in phantom in FIG. 1 and in FIG. 2). The door leaf could also be mounted on the door frame for sliding movement between its open and closed positions without departing from the scope of the invention.

Figure 4:
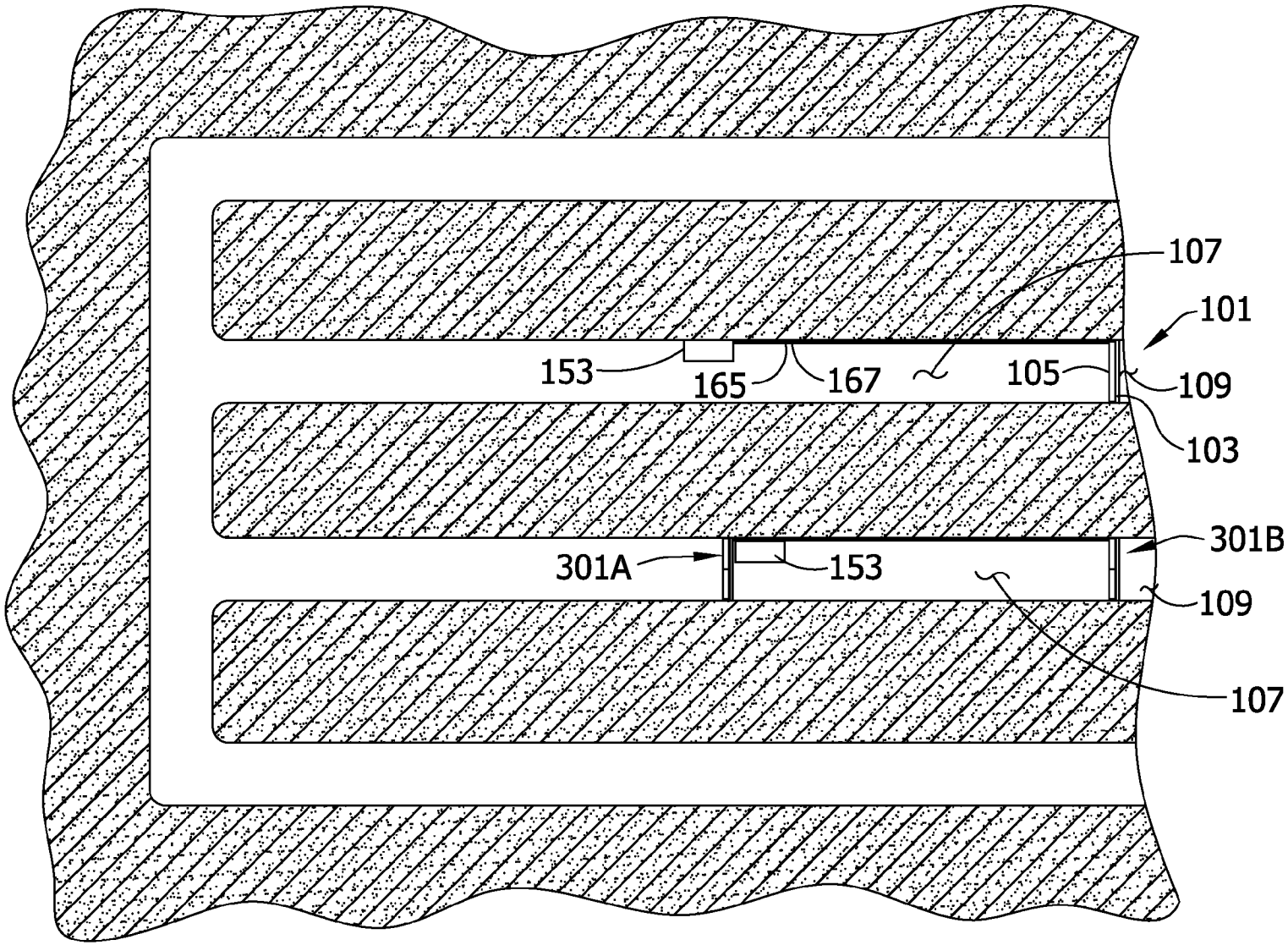
FIG. 4 is a schematic plan view of a network of mine passageways and some door installations of embodiments of the present invention installed therein.

As shown in FIGS. 2 and 4, the door frame 103 is installed in a mine passageway 107 adjacent an opening 109 from the surface into the mine. When the door leaf 105 is in its closed position, the door installation 101 substantially inhibits air flow through the mine passageway 107, as is evident from FIG. 4. Conversely, when the door leaf 105 is in its open position, workers and/or machinery can go through the door installation 101 as they travel along the mine passageway 107 (e.g., to enter or exit the mine). The door installation 101 can be installed elsewhere in the mine or elsewhere outside of the mine without departing from the scope of the invention.

A hydraulic actuator 121 is connected to the door leaf 105 for driving movement of the door leaf between its open and closed positions. As best illustrated in FIG. 1, the hydraulic actuator 121 of the illustrated embodiment is connected to the door leaf 105 so that the actuator drives opening movement of the door leaf 105 by extending itself lengthwise. Likewise the hydraulic actuator 121 drives closing movement of the door leaf 105 by contracting lengthwise. Alternatively, the hydraulic actuator 121 can be connected to the door leaf through a different mechanical linkage (e.g., a bell crank linkage) so that extension of the actuator moves the door from its open position to its closed position and vice-versa.

The hydraulic actuator 121 is suitably a conventional double acting hydraulic cylinder. As is generally known to those skilled in the art, a double acting hydraulic cylinder generally comprises a piston 123 slideably received in a chamber 125 so that the piston separates the chamber into two sections, the volumes of which change as the piston slides axially in the chamber. A rod 127 is secured at one end to the piston 123 and arranged so that the opposite end of the rod extends to the exterior of the chamber 125 through an opening 129 at a rod end 131 of the cylinder. The end 133 of the hydraulic actuator opposite the rod end is referred to herein as the blind end.

Movement of the piston 123 axially in the cylinder 121 is driven by pumping hydraulic fluid into the chamber 125 through a rod end port 135, which is connected to the rod end section 137 of the chamber, or a blind end port 139, which is connected to the blind end section 141 of the chamber. When fluid is pumped into the blind end section 141 of the chamber 125 through the blind end port 139, the piston 123 moves axially in the chamber toward the rod end 131, causing the rod 127 to extend farther from the rod end of the actuator 121 while fluid leaves the rod end section 137 of the chamber through the rod end port 135. Conversely, when fluid is pumped into the rod end section 137 of the chamber 125 through the rod end port 135, the piston moves toward the blind end 133, thereby retracting the rod 127 while fluid leaves the blind end section 141 of the chamber through the blind end port 139. Other hydraulic actuators (including hydraulic actuators that are operable to drive movement of the door leaf 105 in only one direction) can be used instead of the double acting hydraulic cylinder illustrated in the drawings without departing from the scope of the invention.

Figure 3A:
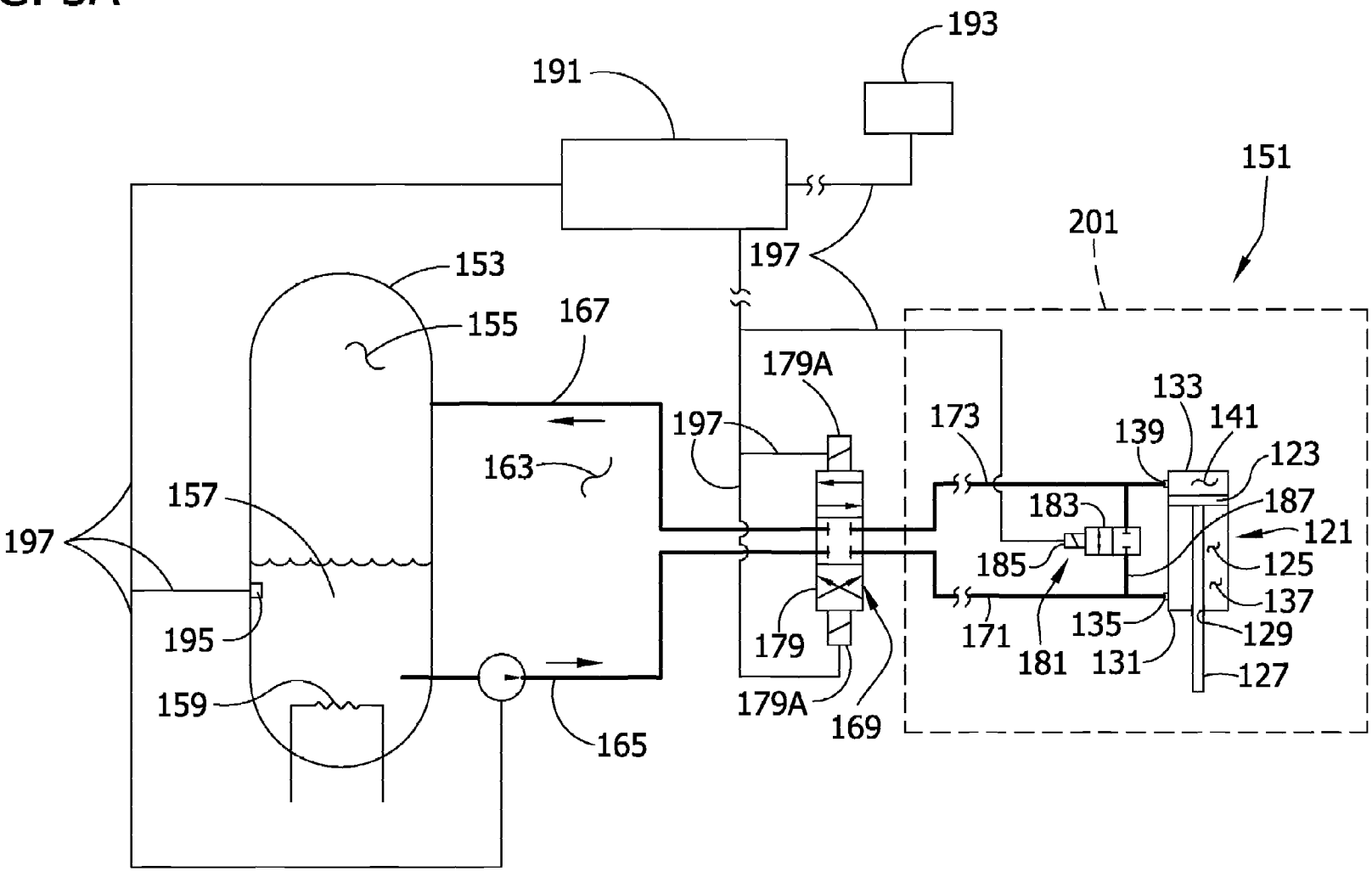
FIGS. 3A and 3B are schematic diagrams of one embodiment of a hydraulic system of the single leaf door installation illustrated in FIGS. 1 and 2.
Figure 3B:
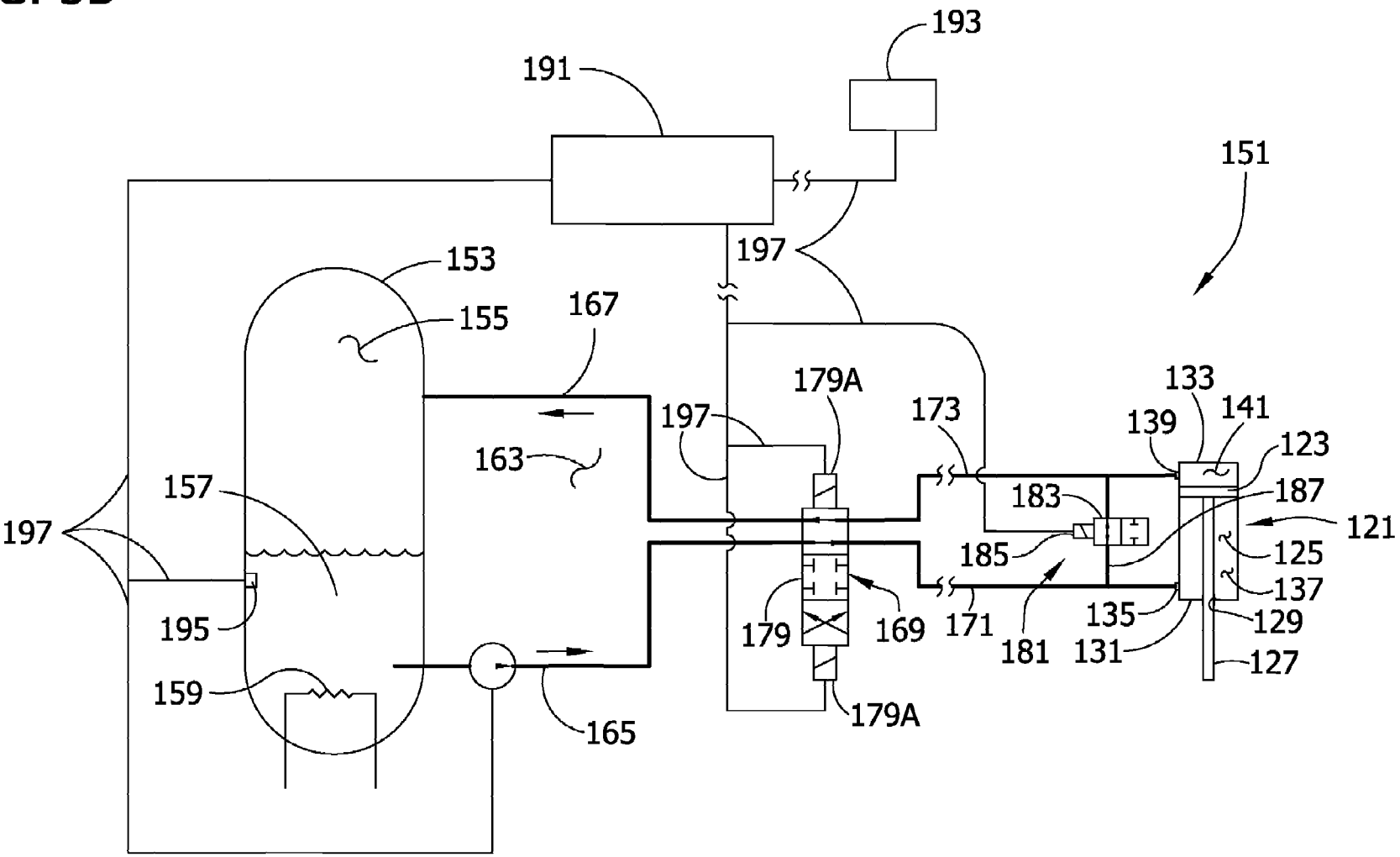

The hydraulic actuator 121 is a component of one embodiment of a hydraulic system 151 of the present invention, which is illustrated schematically in FIGS. 3A and 3B. The hydraulic system 151 includes a reservoir 153 having a volume 155 for containing a hydraulic fluid 157 used to operate the hydraulic actuator 121. In one embodiment of the invention, the reservoir 153 contains a fire-resistant hydraulic fluid 157. For example, the hydraulic fluid 157 may comprise one or more substances selected from the group consisting of ethylene glycol, polyglycols, water glycol, vegetable oil, phosphate esters, polyol esters, synthetic esters, natural esters, invert emulsions, high water based fluid (e.g., 95-5 fluid) and combinations thereof. In one embodiment, the hydraulic fluid 157 is a fire resistant fluid, meaning that the fluid is considered fire resistant as defined by U.S. mine safety regulations at 30 CFR § 35.21. In another embodiment of the invention, the hydraulic fluid 157 is a fluid that does not ignite when sprayed onto an ignition source. In still another embodiment of the invention, the hydraulic fluid 157 is a fluid that is either non-combustible or that self-extinguishes after removal of the ignition source if it is combustible. The hydraulic fluid 157 can be a non fire-resistant hydraulic fluid (e.g., mineral oil or other petroleum products) without departing from the scope of the invention.

The hydraulic system 151 also includes a pump 161 and a fluid circuit 163 that provides fluid communication between the reservoir 153 and the hydraulic actuator 121. The reservoir 153 is suitably a relatively long way away from the hydraulic actuator 121. For example, in one embodiment of the invention, the flow path through the fluid circuit 163 from the reservoir to the hydraulic actuator 121 is suitably at least about 15 meters, more suitably at least about 30 meters, more suitably at least about 50 meters, more suitably at least about 100 meters, still more suitably at least about 500 meters, still more suitably at least about 1000 meters, and still more suitably a distance in the range of about 15 meters to about 7000 meters (7 kilometers). In view of the foregoing, it will be appreciated that at last some of the fluid lines in the fluid circuit are suitably relatively long fluid lines.

One embodiment of suitable fluid circuit 163 is illustrated in FIGS. 3A and 3B, for instance. The fluid circuit 163 includes two fluid lines 165, 167 connecting the reservoir 153 to a directional valve 169 for controlling the direction in which the actuator 121, and therefore the door leaf 105, moves. The pump 161 is operable to pump hydraulic fluid 157 from the reservoir 153 into one of the fluid lines 165. Hydraulic fluid 157 is returned from the fluid circuit 163 to the reservoir 153 through the other line 167. The directional valve 169 is suitably relatively close to the pump 161 and reservoir 153. Accordingly, the fluid lines 165, 167 connecting the reservoir 153 to the directional valve 169 are suitably relatively shorter compared to other fluid lines in the fluid circuit.

The fluid circuit 163 also includes two fluid lines 171, 173 connecting the directional valve 169 to the hydraulic actuator 121. One of the fluid lines 171 is connected to the rod end port 135 and the other fluid line 173 is connected to the blind end port 139. The fluid lines 171, 173 connecting the directional valve 169 to the actuator 121 are suitably substantially longer than the fluid lines 165, 167 connecting the directional valve to the reservoir 153, as indicated by the breaks therein in FIGS. 3A-3B. For example, in one embodiment of the invention each of the fluid lines 171, 173 suitably has a length of at least about 15 meters, more suitably at least about 30 meters, more suitably at least about 50 meters, more suitably at least about 100 meters, still more suitably at least about 500 meters, still more suitably at least about 1000 meters, and still more suitably at distance in the range of about 30 meters to about 7000 meters (7 kilometers). The directional valve 169 is moveable between a first position (shown in FIG. 3B) in which hydraulic fluid 157 can be pumped into the rod end section 137 of the chamber 125 for retracting the rod 127 and a second position (not shown) in which hydraulic fluid can be pumped into the blind end section 141 of the chamber for extending the rod. For example, in the illustrated embodiment the directional valve 169 includes a valve spool 179 spring biased to a neutral position (shown FIG. 3A) and moveable (e.g., by solenoid actuators 179*a*) to its first and second positions.

The temperature of the hydraulic fluid 157 in the reservoir 153 is preferably maintained above a lower limit of a desired operating range for the hydraulic fluid. In one embodiment of the invention, a heater is in thermal communication with the volume 155 of the reservoir 153 to heat the hydraulic fluid 157 in the reservoir. For instance, in FIGS. 3A and 3B, an electrical resistance heater 159 is positioned in the reservoir to heat the hydraulic fluid 157. Operation of the heater 159 can be regulated by a thermostat (not shown) so that the hydraulic fluid 157 is not overheated and to avoid operating the heater unnecessarily. Other types of heaters are also suitable, such as a system (not shown) that pumps the hydraulic fluid through an orifice or other restriction to generate frictional heating of the hydraulic fluid 157.

Further, a heater is not necessarily required to maintain temperature of the hydraulic fluid 157 in the reservoir in the desired operating range. As shown in FIG. 4, for instance, the door leaf 105 is adjacent a low temperature source. In FIG. 4, the door leaf is an exterior door leaf in that it is adjacent the opening 109 to the surface. The door leaf could be adjacent a low temperature source deeper in the mine, such as an intake airway or the bottom of a mine shaft, without departing from the scope of the invention. The reservoir 153 is positioned in the mine at a location farther from the lower temperature source than the door leaf 105. It will be appreciated that some parts of the interior of the mine may be insulated to some degree from the surface or other low temperature source and may be substantially warmer than the temperature of the environment surrounding the door leaf 105. Further, the hydraulic actuator 121 and the portion of the fluid circuit 163 connected thereto can be exposed to significantly cooler temperatures than the reservoir 153 in these circumstances. Accordingly, even when the temperature at the door leaf 105 is substantially below the desired operating temperature range for the hydraulic fluid 157, the reservoir 153 may be positioned in a part of the mine that is maintained at a warm enough temperature to maintain the hydraulic fluid in the reservoir at a temperature above the lower limit of the desired operating range by heat transfer from the local environment surrounding the reservoir 153 to the hydraulic fluid. For instance, in one embodiment of the invention, the reservoir 153 is suitably positioned at least about 15 meters farther from the low temperature source than the door leaf, and more suitably at least about 30 meters farther from the low temperature source than the door leaf. Further, the reservoir 153 can be insulated from the low temperature source by the mine and also be heated by a heater 159 at the same time, as is the case with the embodiment illustrated in FIGS. 3A-4.

The hydraulic system 151 also includes a fluid circuit flushing system 181 operable to flush hydraulic fluid 157 from the fluid circuit 163 into the reservoir 153 without operating the hydraulic actuator 121 and without moving the door leaf 105. One embodiment of the fluid circuit flushing system 181 is suitably operable to flush at least about 50 percent of the volume of hydraulic fluid 157 in the fluid circuit 163 out of the fluid circuit, more suitably at least about 80 percent of the volume of hydraulic fluid in the fluid circuit, and still more suitably at least about 90 percent of the volume of hydraulic fluid in the fluid circuit. The volume of hydraulic fluid 157 in the fluid circuit 163 can be determined by subtracting the volume of hydraulic fluid in the reservoir 153 and in the chamber 125 of the hydraulic actuator 121, and any other actuators, from the total volume of hydraulic fluid in the hydraulic system 151).

Referring to FIGS. 3A and 3B, one embodiment of the fluid circuit flushing system 181 includes a bypass valve 183 moveable between at least one working position (shown in FIG. 3A), in which hydraulic fluid 157 can be pumped into the fluid circuit 163 to operate the hydraulic actuator 121, and a bypass position (shown in FIG. 3B) in which hydraulic fluid pumped into the fluid circuit flushes hydraulic fluid from the fluid circuit into the reservoir 163 without operating the hydraulic actuator 121 or moving the door leaf 105. In FIGS. 3A and 3B, the bypass valve 183 includes a solenoid actuator 185 for moving the valve between its working and bypass positions. The bypass valve 183 is installed in a bypass line 187 connecting the rod end port 135 to the blind end port 139 of the hydraulic actuator 121 and connecting the fluid lines 171, 173 connecting the directional valve 169 to the hydraulic actuator.

The bypass valve 183 is suitably remote from the reservoir 153 and close to the hydraulic actuator 121. For instance, the bypass valve 183 is suitably on the opposite side of the directional valve 169 in the fluid circuit 163 as the reservoir 153. In one embodiment of the invention, the bypass valve is suitably no more than about 15 meters from the hydraulic actuator 121, and more suitably no more than about 10 meters from the hydraulic actuator. The hydraulic system 151 may be arranged so the bypass valve 183 is relatively farther from the reservoir 153 and relatively closer to the hydraulic actuator 121 to facilitate flushing a greater percentage of the volume of hydraulic fluid 157 in the fluid circuit 163 from the fluid circuit into the reservoir. In one embodiment of the invention, for example, the bypass valve 183 is suitably at least about 15 meters away from the reservoir, more suitably at least about 30 meters away from the reservoir, more suitably at least about 50 meters away from the reservoir, more suitably at least about 100 meters from the reservoir, still more suitably at least about 500 meters from the reservoir, and still more suitably at least about 1000 meters from the reservoir. In another embodiment of the invention the fluid circuit 163 of the hydraulic system 151 is arranged so the shortest path through the fluid circuit between the bypass valve 183 and the reservoir 153 is at least about 15 meters, more suitably at least about 30 meters, more suitably at least about 50 meters, more suitably at least about 100 meters, still more suitably at least about 500 meters, and still more suitably at least about 1000 meters from the reservoir. Although the bypass valve 183 and directional valve 169 are two different valves in the illustrated embodiment, the skilled person will recognize that the directional valve and bypass valve may be integrated into a single valve (e.g., suitably by modifying the valve spool 179 of the directional valve to include a bypass position and moving it in the fluid circuit to the position of the bypass valve 183) without departing from the scope of the invention.

Still referring to FIGS. 3A and 3B, the fluid circuit flushing system 181 also includes a control system 191 operable to move the bypass valve 183 to its bypass position (e.g., by activating the solenoid 185) and to activate the pump 161 when the bypass valve is in its bypass position to pump hydraulic fluid 157 from the reservoir 153 into the fluid circuit 163, thereby flushing the hydraulic fluid initially in the fluid circuit back into the reservoir. The control system 191 is also operable to move the directional valve 169 from its neutral position to a position that allows hydraulic fluid 157 to flow from the reservoir 153 to the bypass valve 183 through the directional valve (e.g., as shown in FIG. 3B). For example, the control system 191 can move the spool 179 of the directional valve 169 to the desired position for flushing using the solenoid actuators 179*a*. In the embodiment shown in the drawings, wiring 197 is provided to connect the control system 191 to other components of the hydraulic system 151. However, it is understood that wireless communication can be used by the control system and other components of the hydraulic system without departing from the scope of the invention.

The control system 191 is operable to implement a fluid circuit flushing routine, meaning that it has at least one of instructions and circuitry for implementing the fluid circuit flushing routine. The fluid circuit flushing routing includes moving the bypass valve 183 to its bypass position and operating the pump 161 to pump hydraulic fluid 157 from into the fluid circuit 163 while the bypass valve is in its bypass position. The control system 191 also has a timer (not shown) for keeping track of elapsed time during implementation of the steps of the fluid circuit flushing routine. For example, the timer may be operable to measure an amount of time that the pump 161 has been idle and/or an amount of time that the pump has been operating. Information about the activity (or lack thereof) of the pump 161 can be used by the processor in the implementation of the fluid circuit flushing routine to determine whether to initiate or continue flushing of hydraulic fluid 157 from the fluid circuit 163.

The hydraulic system 151 illustrated in FIGS. 3A and 3B includes two temperature sensors to facilitate implementation of the fluid circuit flushing routine. An ambient temperature sensor 193 is positioned to measure an ambient temperature (e.g., at the hydraulic actuator 121). The ambient temperature sensor 193 outputs a signal indicative of the ambient temperature to the control system 191. Similar information can be obtained by a temperature sensor (not shown) positioned to measure the temperature of the hydraulic fluid 157 in the fluid circuit instead of or in addition to the ambient temperature sensor 193 without departing from the scope of the invention. The hydraulic system 151 includes another temperature sensor 195 positioned to measure a temperature of the hydraulic fluid 157 in the reservoir 153. The fluid temperature sensor 195 outputs a signal to the control system 191 that is indicative of the temperature of the hydraulic fluid 157 in the reservoir 153. In the embodiment illustrated in FIGS. 3A and 3B, the fluid temperature sensor 195 is spaced from the heater 159 to limit influence of any localized heating produced by the heater on the fluid temperature sensor. However, the fluid temperature sensor 195 can be adjacent the heater 159 without departing from the scope of the invention.

In one embodiment of the invention the fluid circuit flushing routine includes flushing hydraulic fluid 157 from the fluid circuit 163 only if the ambient temperature measured by the ambient temperature sensor 193 (or a temperature of the hydraulic fluid 157 in the fluid circuit) is below a specified temperature. Further, the control system 191 suitably uses information about the temperature of the hydraulic fluid 157 in the reservoir 153 and/or information from the timer about how long the system has been flushing fluid from the circuit 163 to determine whether or not continued flushing of the fluid circuit is called for by the fluid circuit flushing routine. The fluid circuit flushing routine will be discussed in more detail in the description of the operation of the hydraulic system below.

With respect to opening and closing of the door leaf 105, the door installation 101 operates in much the same way as a conventional hydraulically powered door installation. When installed in a mine passageway, the door leaf 105 of the installation is normally in its closed position to inhibit air flow through the mine passageway. Briefly, when the door is to be opened, a user sends a signal to the control system 191 to open the door (e.g., by pushing a palm button (not shown), tripping an automatic switch (not shown), or by another suitable input device). Upon receiving the open door signal, the control system 191 moves the spool 179 of the directional valve 169 to a position in which it directs hydraulic fluid 157 pumped into the fluid circuit 163 by the pump 161 into the blind end section 141 of the chamber 125 in the hydraulic actuator 121. The control system 191 also activates the pump 161 to pump hydraulic fluid 157 into the fluid circuit to extend the rod 127 and thereby move the door leaf 105 to its open position. Similarly, when the control system 191 receives a close door signal input by the user, it positions the directional valve 169 to pump hydraulic fluid 157 into the rod end section 137 of the chamber 125 of the hydraulic actuator 121 and activates the pump 161 to retract the rod 127 of the hydraulic actuator 121 and thereby move the door leaf 105 to its closed position.

One embodiment of a method of the invention includes heating the hydraulic fluid 157 in the reservoir 153. For example, the hydraulic fluid may be heated by the heater 159. Heating of the hydraulic fluid 157 can also be accomplished by arranging the hydraulic system 151 so that the reservoir 153 is located in a relatively warmer environment than other parts of the hydraulic system (e.g., the hydraulic actuator 121 and/or exterior door leaf 105), in which case hydraulic fluid 157 that has cooled in the fluid circuit is automatically heated when it is returned to the reservoir 153 because of the relatively warmer environment surrounding the reservoir. The method also includes pumping the heated hydraulic fluid 157 from the reservoir 153 into the fluid circuit 163 to flush hydraulic fluid that has cooled in the fluid circuit 163 back into the reservoir without operating the hydraulic actuator 121 and without moving any of the one or more door leaves (for instance without moving the single door leaf 105 in the embodiment illustrated in FIGS. 1-3A).

The method is suitably implemented by the control system 191 as a part of a fluid circuit flushing routine. In one embodiment, the initial step of the fluid circuit flushing routine is to check the ambient temperature measured by the ambient temperature sensor 193 (or a temperature of the hydraulic fluid in the fluid circuit 163) to determine if flushing is needed. The method includes flushing hydraulic fluid 157 from the fluid circuit 163 only when the ambient temperature (or temperature of the hydraulic fluid 157 in the fluid circuit 163) is below a specified temperature. This avoids wasting energy by flushing hydraulic fluid 157 from the fluid circuit 163 when the hydraulic fluid remains sufficiently warm in the fluid circuit 163 (e.g., during warm weather).

If the control system 191 determines that flushing is called for, the control system 191 at least periodically causes relatively warmer hydraulic fluid 157 from the reservoir 153 to be pumped into the fluid circuit 163 to flush the relatively cooler hydraulic fluid that is initially in the fluid circuit back into the reservoir 153 where it can be heated. This replaces the relatively cooler hydraulic fluid 157 that is initially in the fluid circuit 163 with the relatively warmer hydraulic fluid from the reservoir 153. In the embodiment shown in FIGS. 3A-3B, for example, the control system 191 moves the directional valve 169 (e.g., using at least one of the solenoid actuators 179*a* to move the valve spool 179) to a position that allows fluid to flow from the reservoir 153 to the bypass valve 183 and also to flow from the bypass valve to the reservoir (e.g., the position shown in FIG. 3B). The control system 191 also moves the bypass valve 183 to its bypass position (shown FIG. 3B), for example using the solenoid actuator 185 associated with the bypass valve. Then the control system 191 activates the pump 161 to begin pumping the relatively warmer hydraulic fluid 157 from the reservoir 153 into the fluid circuit 163. As the relatively warmer hydraulic fluid 157 flows into the fluid circuit 163, the relatively cooler hydraulic fluid already in the fluid circuit is flushed back to the reservoir 153 through the return line 167.

Flow of hydraulic fluid 157 through the fluid circuit 163 bypasses the hydraulic actuator 121 through the bypass valve 183 and bypass line 187. Accordingly, the flushing of hydraulic fluid 157 from the fluid circuit 163 does not involve operation of the hydraulic actuator 121 or movement of the door leaf 105. Further, because the bypass valve 183 is arranged to be remote from the reservoir (e.g., more than 50 meters away from the reservoir), the fluid circuit flushing routine flushes a substantial percentage of the hydraulic fluid 157 in the fluid circuit 163 back to the reservoir. For example, in one embodiment of the invention suitably at least about 50 percent of the total volume of hydraulic fluid 157 in the fluid circuit 163 is flushed from the circuit, and more suitably at least about 80 percent of total volume of hydraulic fluid in the circuit is flushed, and still more suitably at least about 90 percent of the total volume of hydraulic fluid in the circuit is flushed.

The fluid circuit flushing routine suitably comprises deactivating the pump 161 after the relatively cooler hydraulic fluid 157 has been purged from the part of the fluid circuit that is flushed by the flushing system 181 and returned to the reservoir 153. For example, one embodiment of the fluid circuit flushing routine includes operating the pump 161 to flush hydraulic fluid 157 from the fluid circuit 163 for a specified period of time (e.g., as tracked by the timer of the control system 191) and then turning the pump off. The specified time may be approximately the length of time needed to completely purge the relatively cooler hydraulic fluid 157 from the part of the fluid circuit being flushed by the flushing system 181. In another embodiment, the fluid circuit flushing routine includes operating the pump 161 to flush hydraulic fluid 157 from the fluid circuit 163 until the temperature sensor 195 detects a rise in the temperature of the hydraulic fluid 157 in the reservoir 153, which is a sign that the relatively warmer hydraulic fluid being pumped into the fluid circuit 163 has made its way all the way through the fluid circuit back to the reservoir, and then deactivating the pump.

After the relatively warmer hydraulic fluid 157 that was pumped into the fluid circuit 163 during the flushing has cooled (e.g., as indicated by the amount of time that has elapsed since the pump 161 was last activated and/or by temperature measurement of the hydraulic fluid in the fluid circuit), the control system 191 suitably reactivates the pump 161 to flush the cooled hydraulic fluid from the circuit again in the same manner.

Figure 5A:
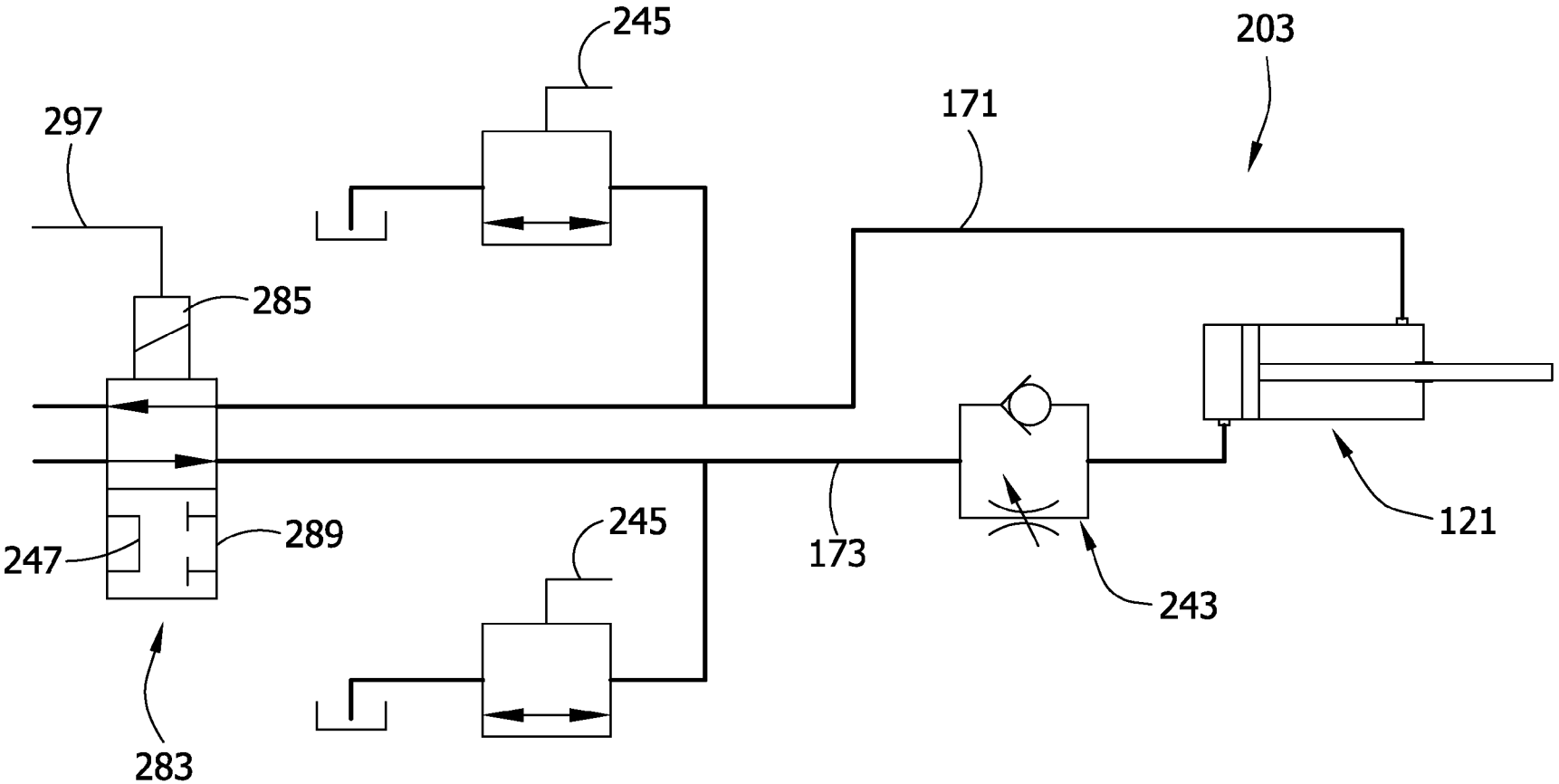
FIGS. 5A and 5B are schematic diagrams of a portion of another embodiment of a hydraulic system for use with a single leaf door installation as illustrated in FIG. 1.
Figure 5B:
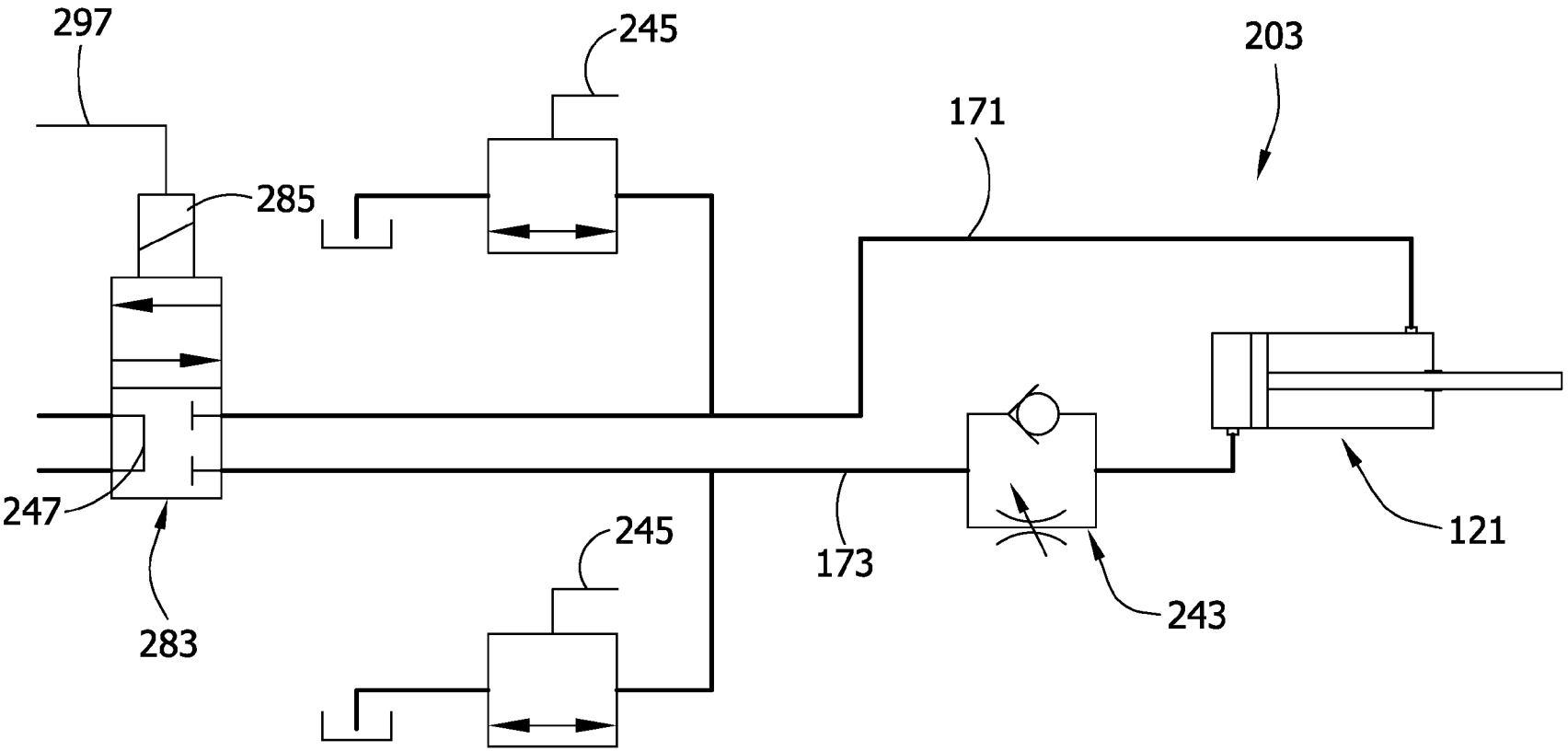

A portion of another embodiment of a hydraulic system of the present invention is substantially the same as the hydraulic system 151 described above except that the portion of the fluid circuit 163 inside the box labeled 201 in FIG. 3A has been replaced with the fluid sub-circuit 203 illustrated in FIGS. 5A and 5B. The bypass valve 283 of the fluid sub-circuit 203 has a valve spool 289 moveable (e.g., by a solenoid actuator 285 controlled by the processor 191 via wiring 297) between a working position (shown in FIG. 5A) and a bypass position (shown in FIG. 5B). When the valve spool 289 is in its working position, fluid can flow from the directional valve 169 to the actuator 121 through the bypass valve 283. When the valve spool 289 is in its bypass position, fluid flowing to the bypass valve 283 from the directional valve 169 is returned to the directional valve through an internal passage 247 in the valve spool. When the bypass valve 283 is in the bypass position, the hydraulic fluid 157 is locked in the hydraulic actuator 121, thereby locking movement of the door leaf. Manual release valves 245 allow fluid to be emptied from the actuator 121 to permit manual movement of the door leaf 105, such as in case of an emergency. The fluid sub-circuit 203 also includes an adjustable door leaf closing speed control valve (e.g., an adjustable needle valve 243) for adjusting closing speed of the door leaf 105. The door installation 101 and flushing system 181 operate in a similar manner regardless of which of the fluid sub-circuits 201, 203 is used.

Figure 6:
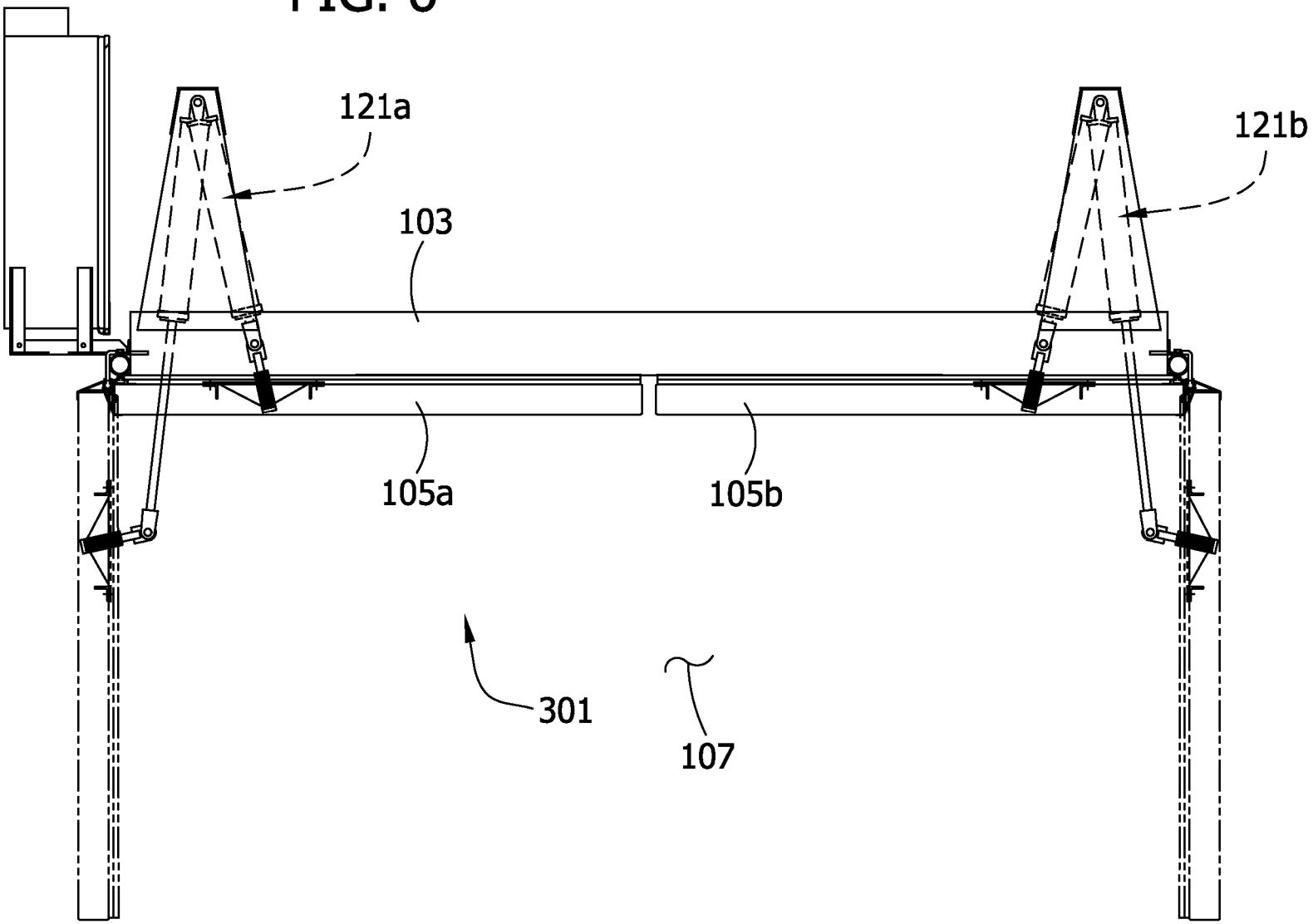
FIG. 6 is plan view of one embodiment of a double leaf door installation of another embodiment of the present invention.
Figure 7A:
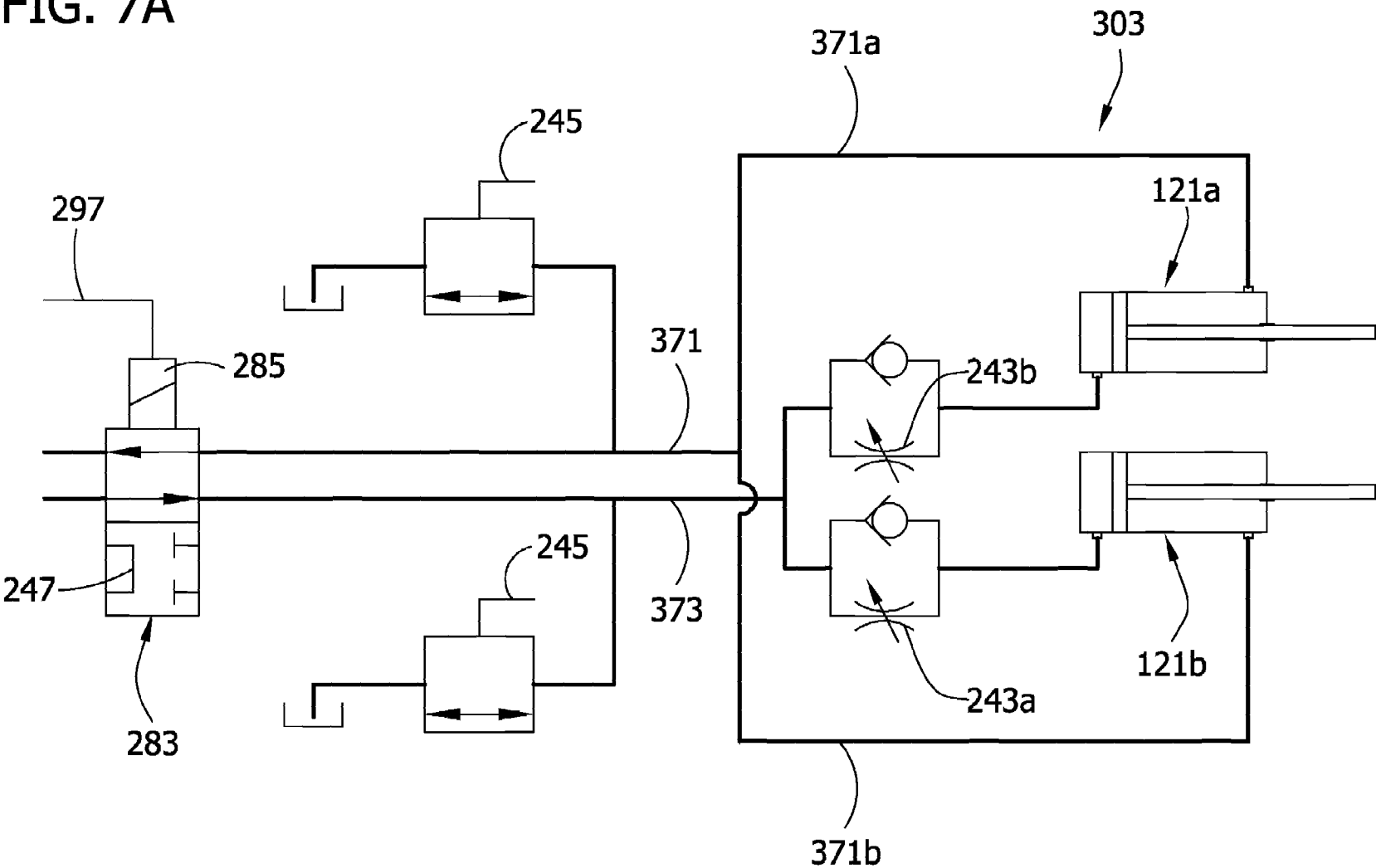
FIGS. 7A and 7B are schematic diagrams of a portion of one embodiment of a hydraulic system of the double leaf door installation illustrated in FIG. 6.
Figure 7B:
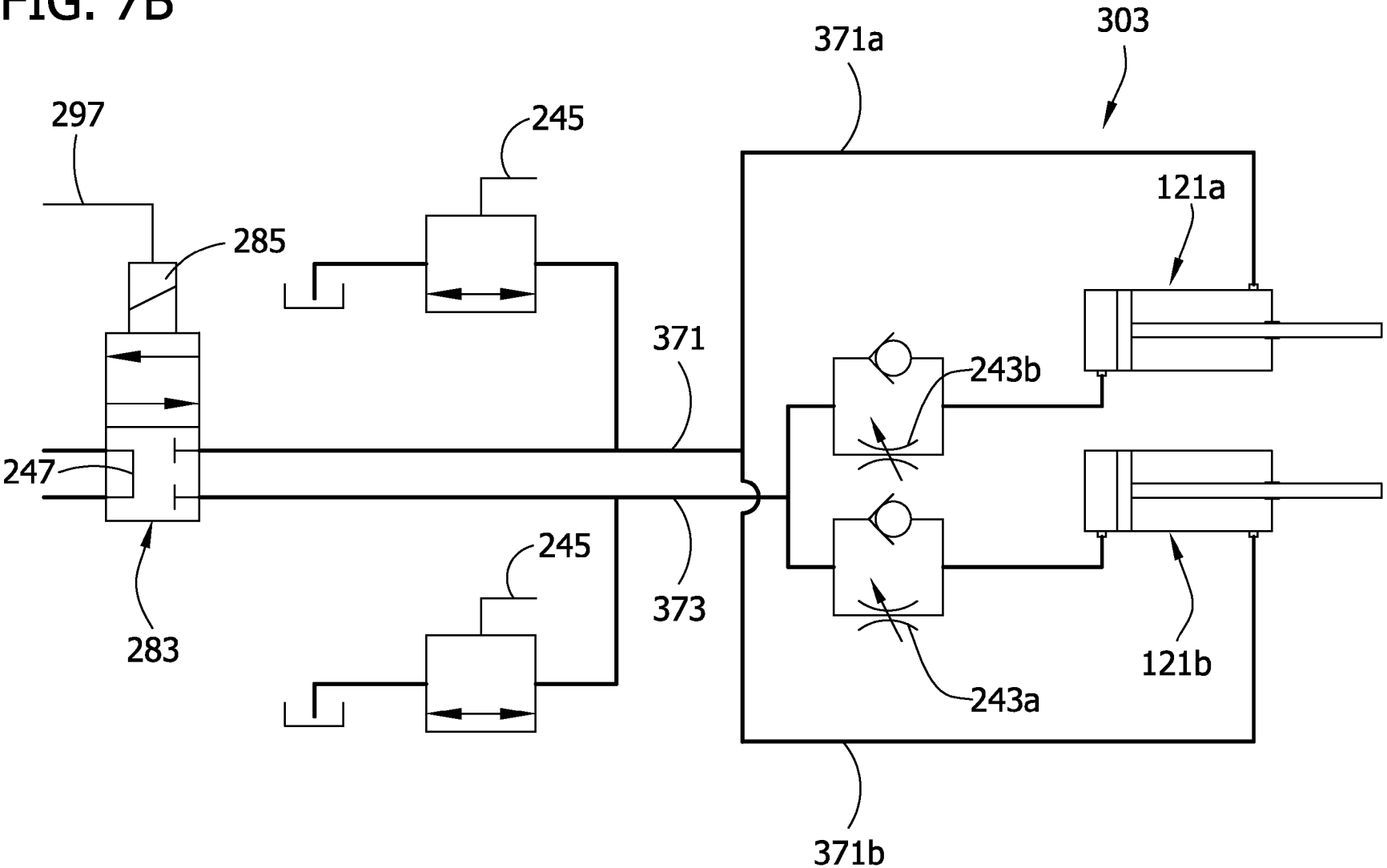

FIGS. 6-7B illustrated another embodiment of the invention. In this embodiment, two door leaves 105*a*, 105*b* are mounted on the door frame 103 to yield a double-leaf door installation 301. Each of a pair of hydraulic actuators 121*a*, 121*b* is connected to a respective one of the door leaves 105*a*, 105*b* to drive movement of the door leaf in substantially the same way described above. The hydraulic system for the double-leaf door installation is substantially the same as the hydraulic system 151 described above, except that fluid sub-circuit 303 has been used in place of the fluid sub-circuit 201 shown in FIG. 3A. The fluid sub-circuit 303 for the double-leaf door installation 301 has the same bypass valve 283 and manual release valves 245 as fluid sub-circuit 203. In order to route hydraulic fluid 157 to both of the hydraulic actuators 121*a*, 121*b* the fluid lines 371, 373 leading from the directional valve 169, through the bypass valve 283, and to the actuators each branch into two fluid lines 371*a*, 371*b*, and 373*a*, 373*b*, respectively, to connect the lines to the two hydraulic actuators 121*a*, 121*b*. Each door leaf 105*a*, 105*b* also has its own independently adjustable closing speed valve 243*a*, 243*b*. The control system 191 is operable to conduct the fluid circuit flushing routine for the double-leaf door installation 301 in substantially the same manner described above.

Figure 8:
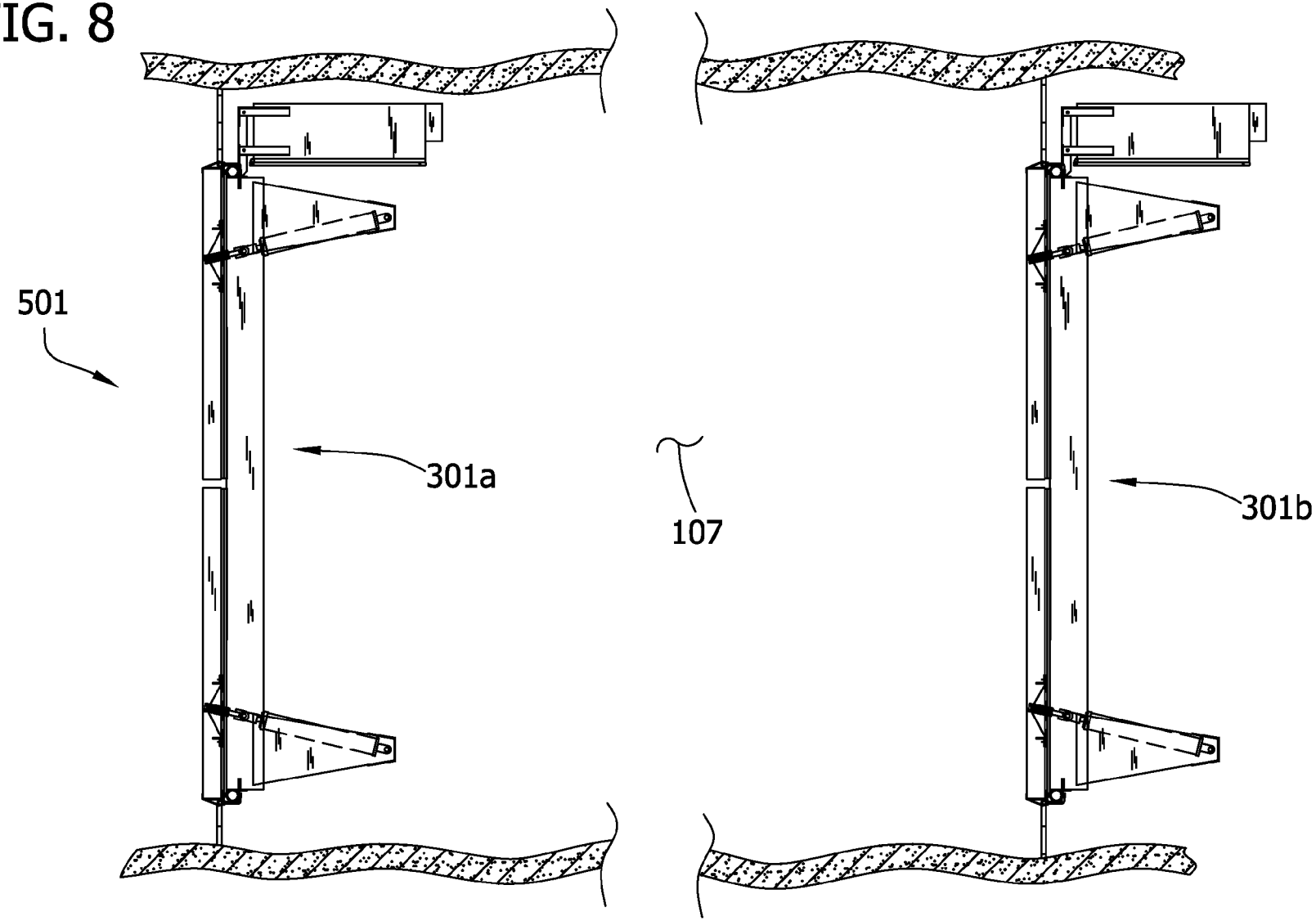
FIG. 8 is a plan view of an airlock of an embodiment of the present invention.
Figure 9A:
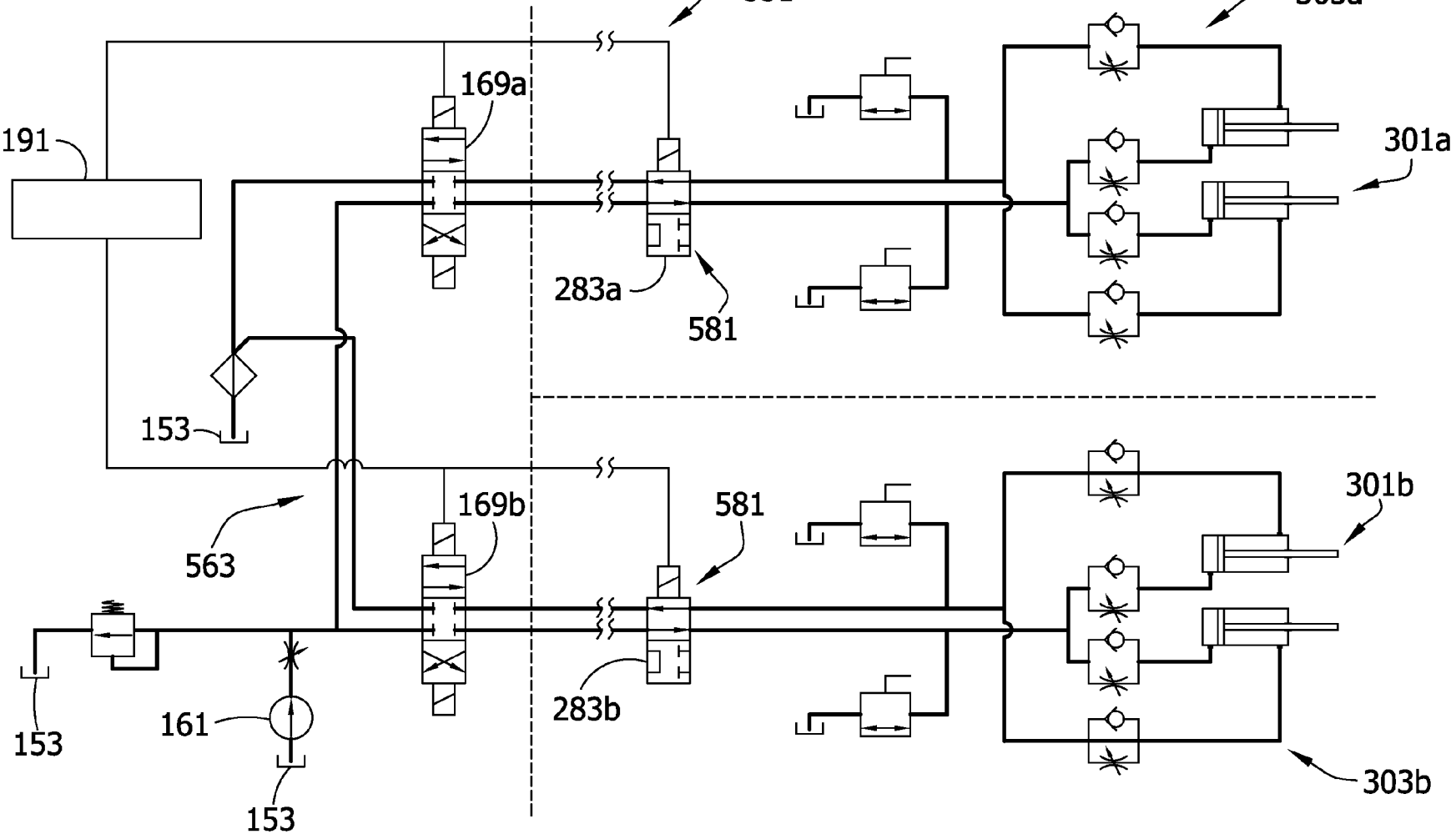
FIGS. 9A-9C are schematic diagrams of one embodiment of a hydraulic system of the airlock illustrated in FIG. 7.
Figure 9B:
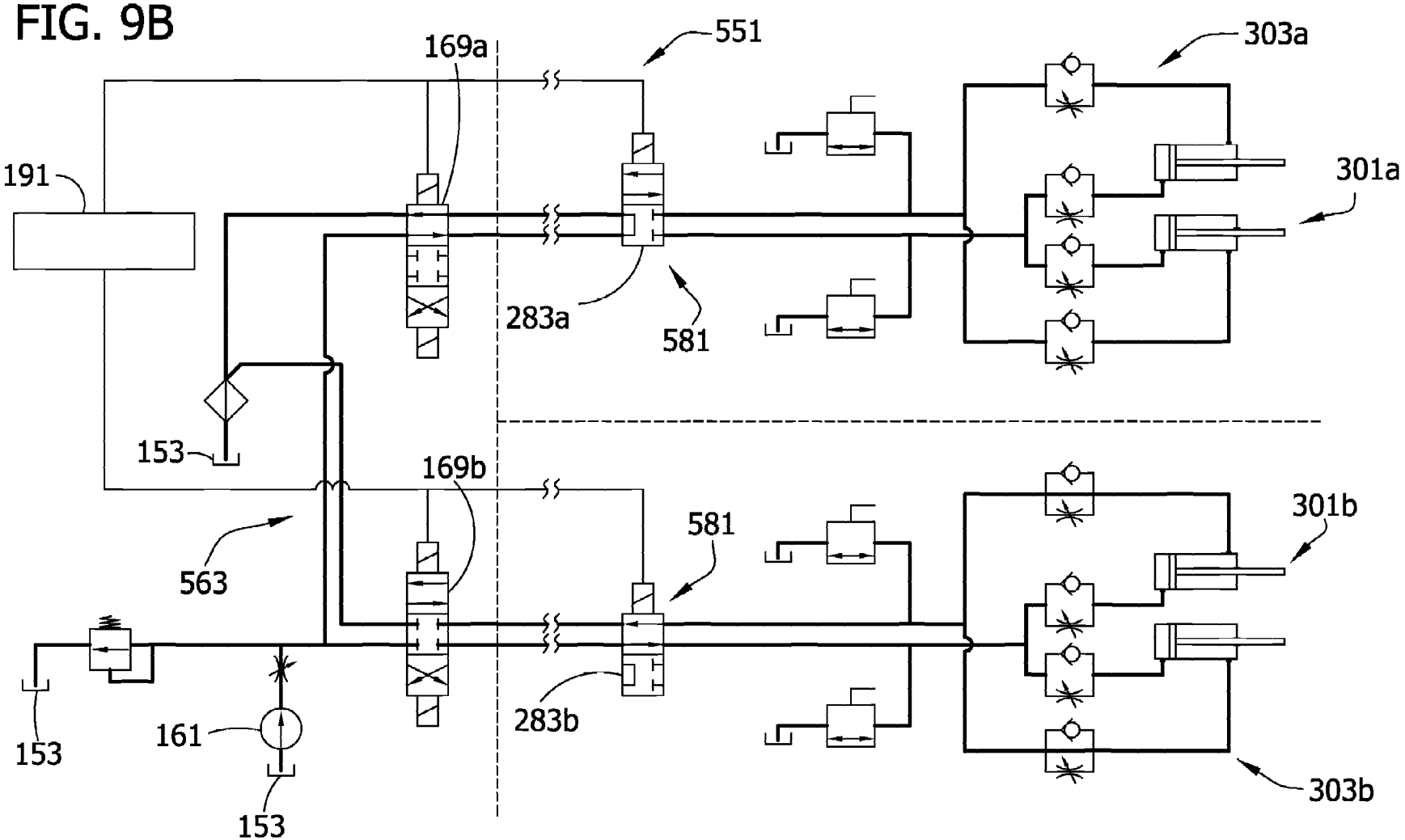
Figure 9C:
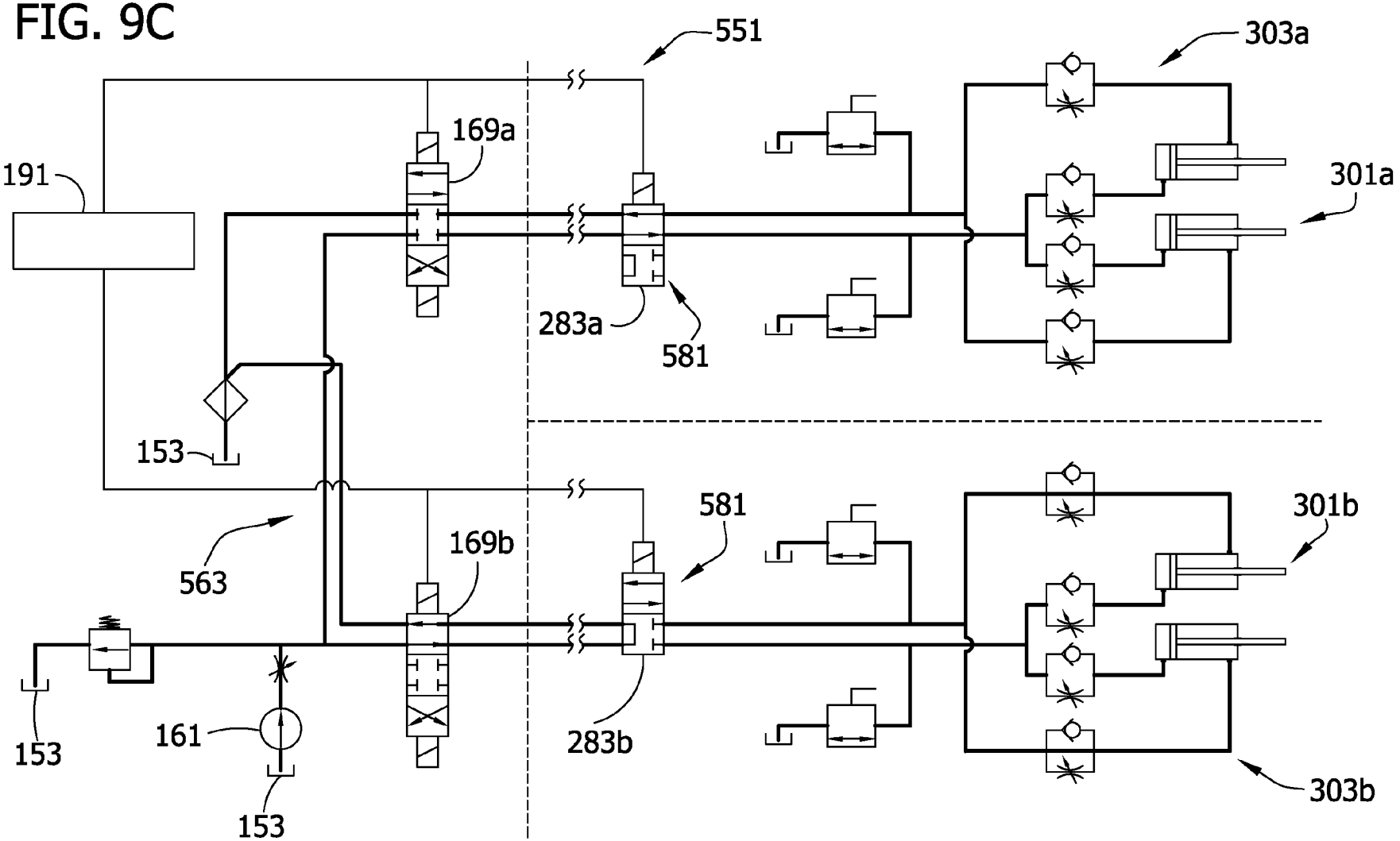

FIGS. 8-9C illustrate one embodiment of a hydraulically powered air lock 501 of the present invention. The air lock comprises two double leaf doors 301*a*, 301*b* (each of which is substantially the same as the double leaf door 301 described above) spaced apart from one another in a mine passageway 107, as illustrated in FIG. 4. The same pump 161 is used to power all of the hydraulic actuators 121, e.g., substantially as set forth in U.S. Pat. No. 6,425,820, which is already incorporated by reference above. Further, in the embodiment illustrated in FIG. 4, one of the doors 301*b* is installed in a mine passageway 107 adjacent a low temperature source (e.g., an opening 109 into the mine), while the other door 301*a* is installed in the mine passageway 107 a distance of at least about 30 meters farther from the low temperature source than the door 301*b*. The reservoir 153 is suitably positioned adjacent the door installation 301*a* where it is more insulated from the low temperature source.

Referring to FIGS. 9A-9C, the hydraulic fluid circuit 551 includes the pump 161 and reservoir 153, as described above. To simplify the circuit diagram in FIGS. 9A-9C (as well as in FIGS. 10A-10D, which are discussed later herein), the reservoir 153 is treated in a manner that is analogous to ground of an electrical system, it being understood that each instance the reservoir symbol labeled "153" is used in the diagram indicates that the fluid line associated therewith is connected to the reservoir 153. The hydraulic system 551 includes a separate fluid sub-circuit 303*a*, 303*b* for each of the doors 301*a*, 301*b*. The fluid sub-circuits 303*a*, 303*b* are substantially the same as the sub-circuit 303 described above, except that additional adjustable needle valves are provided therein to allow independent control of the opening speeds of the door leaves. Each of the fluid sub-circuits 303*a*, 303*b* operates movement of the hydraulic actuators and door leaves of the respective door 301*a*, 301*b* in the same way described above. However, fluid sub-circuit 303*a* is not involved with operation of the other door 301*b* and fluid sub-circuit 303*b* is not involved with operation of door 301*a*.

The fluid circuit 551 is flushed by a fluid circuit flushing system 581, which includes the bypass valves 283*a*, 283*b* gin the fluid sub-circuits 303*a*, 303*b*. The control system 191 is operable to flush hydraulic fluid from each of the fluid sub-circuits 303*a*, 303*b* without moving any of the hydraulic actuators 121 and without moving any of the door leaves. For example, in one embodiment of the invention, the control system 191 is operable to implement a fluid circuit flushing routine in which the fluid sub-circuits 303*a*, 303*b* are flushed sequentially.

In one embodiment of the fluid circuit flushing routine, both of the bypass valves 283*a*, 283*b* are initially in their working positions when the control system 191 determines that flushing is called for (e.g., using information such as the signal from the ambient temperature sensor 193, the amount of time elapsed since the pump was operated as measured by the timer, and/or measurement of a temperature of the hydraulic fluid in the fluid circuit 563). To initiate flushing, the control system 191 first moves the directional valve 169*a* to a position that allows hydraulic fluid 157 to flow from the reservoir to the bypass valve 283*a*, moves the bypass valve 283*a* to its bypass position (as shown in FIG. 9B), and activates the pump 161 to fluid hydraulic fluid from fluid sub-circuit 303*a* in the same manner described above for fluid sub-circuit 303. In one embodiment of the invention, the fluid circuit flushing routine is implemented by continuing to flush hydraulic fluid 157 from the first fluid sub-circuit 303*a* until either: (1) the temperature sensor 195 in the reservoir detects a rise of temperature in the reservoir, thereby indicating that the heated hydraulic fluid pumped from the reservoir into the fluid circuit 563 to flush the first sub-circuit 303*a* has made its way through the sub-circuit back to the reservoir; or (2) the timer indicates that the first sub-circuit 303*a* has been flushed for a specified period of time.

Then the control system 191 moves the bypass valve 283*a* back to its working position, moves the bypass valve 283*b* of the second fluid sub-circuit 303*b* to its bypass position (as shown in FIG. 9C), and moves the directional valves 169*a*, 169*b* to shut off flow of fluid to the first bypass valve 283*a* and permit flow of fluid to the second bypass valve 283*b* g(also as shown in FIG. 9C) so that relatively warmer hydraulic fluid 157 being pumped into the fluid circuit 563 by the pump 161 is now used to flush cooler hydraulic fluid from the second fluid sub-circuit. In one embodiment of the invention, the control system flushes the second fluid sub-circuit 303*b* until the temperature sensor 195 indicates a rise in the temperature of the hydraulic fluid 157 in the reservoir or a specified time has elapsed since the start of flushing of the second fluid sub-circuit. It may be desirable to allow more time to elapse during flushing of the second fluid sub-circuit 303*b* of the embodiment shown in FIG. 4 because the door 301*b* and bypass valve 283*b* thereof are located farther from the reservoir 153 than their counterparts in the first fluid sub-circuit 303*a*, which translates into a larger volume of cooled hydraulic fluid that is to be flushed from the second fluid sub-circuit.

FIGS. 10A-10D illustrate another embodiment of a hydraulic system 651 for use in a door installation (not shown) comprised of three double-leaf doors, suitably each being installed in one or more mine passageways to form an airlock. Each of the three double-leaf doors is substantially the same as the double-leaf door 301 described above. The hydraulic system 651 is substantially the same as the hydraulic system 551 described above, except that a third fluid sub-circuit 303*c* (which is substantially the same as the fluid sub-circuit 303 described above) has been added to connect the reservoir 153 to the hydraulic actuators of the third double-leaf door so that the actuators for all three of the double-leaf doors are powered by the same pump 161.

Figure 10A:
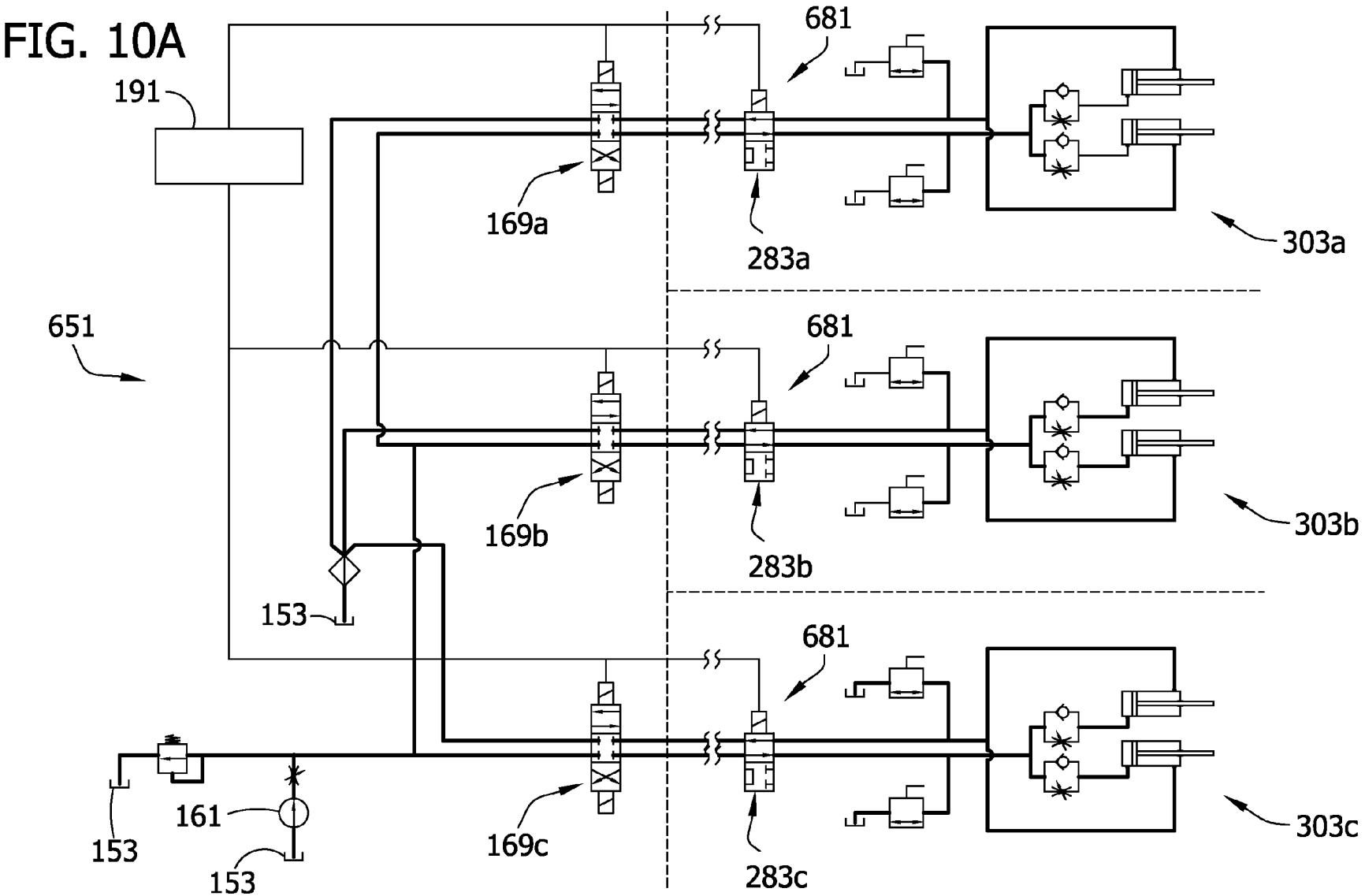
FIGS. 10A-10D are schematic diagrams of one embodiment of a hydraulic system suitable for use with a three door wye door installation.
Figure 10B:
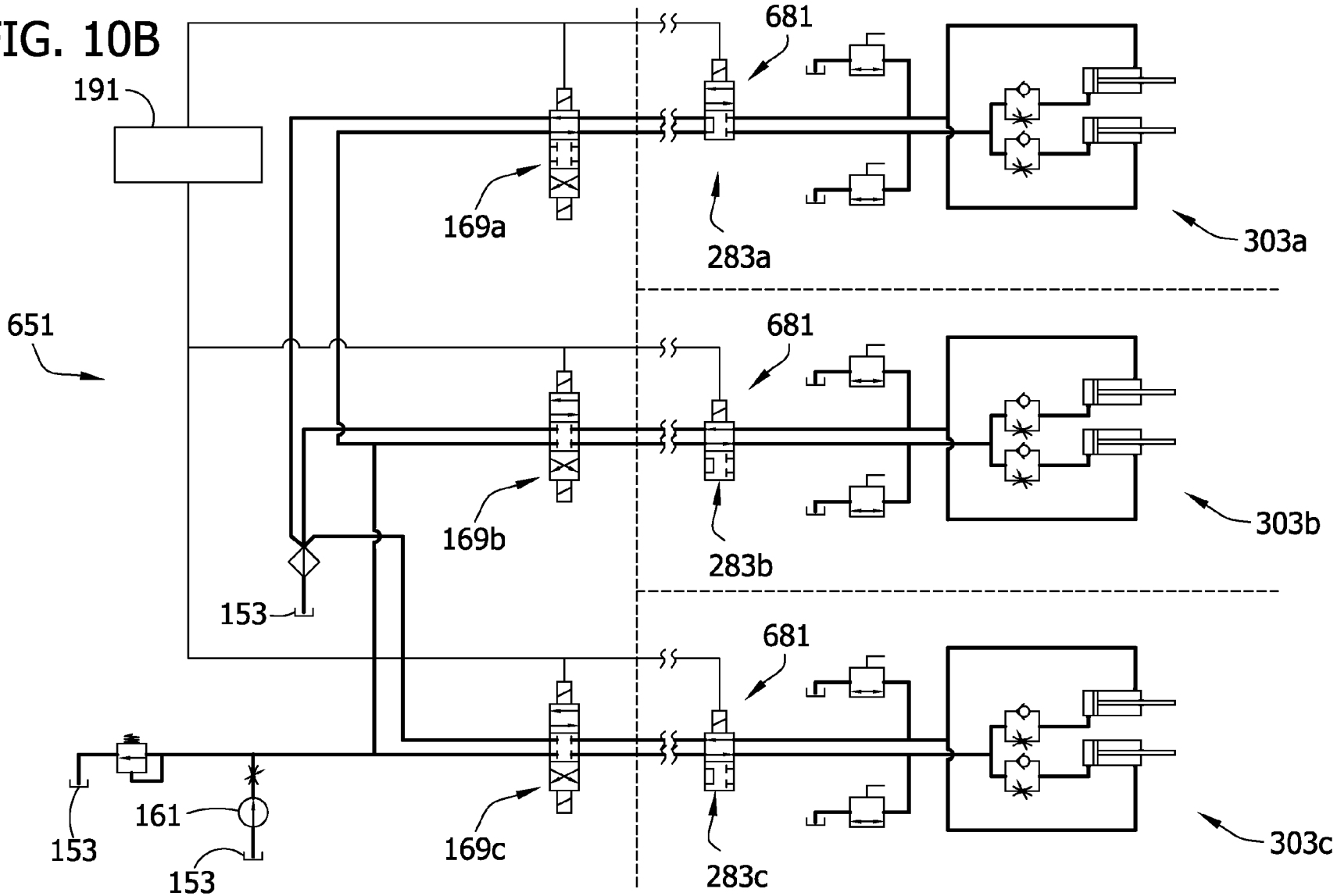
Figure 10C:
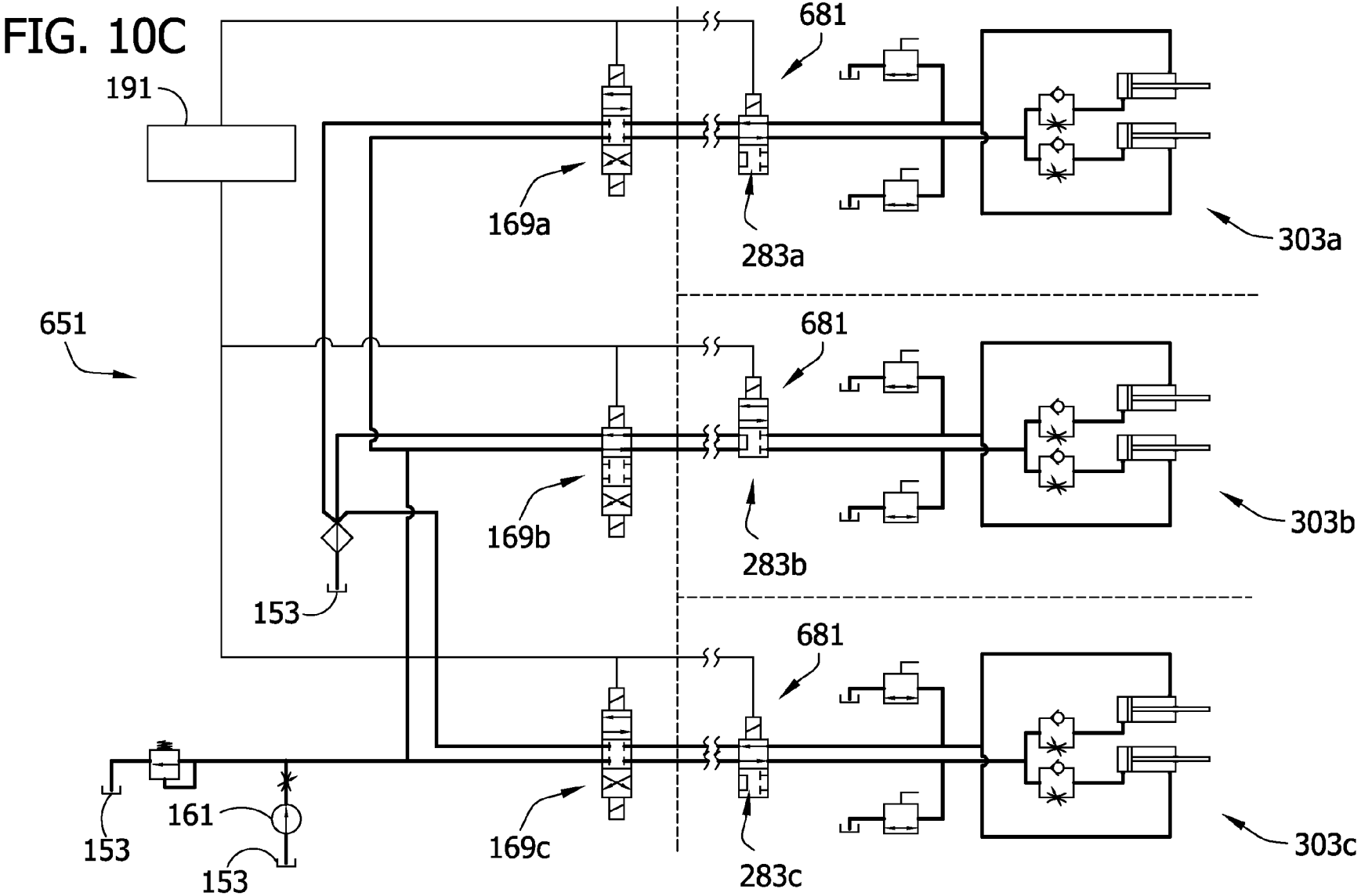
Figure 10D:
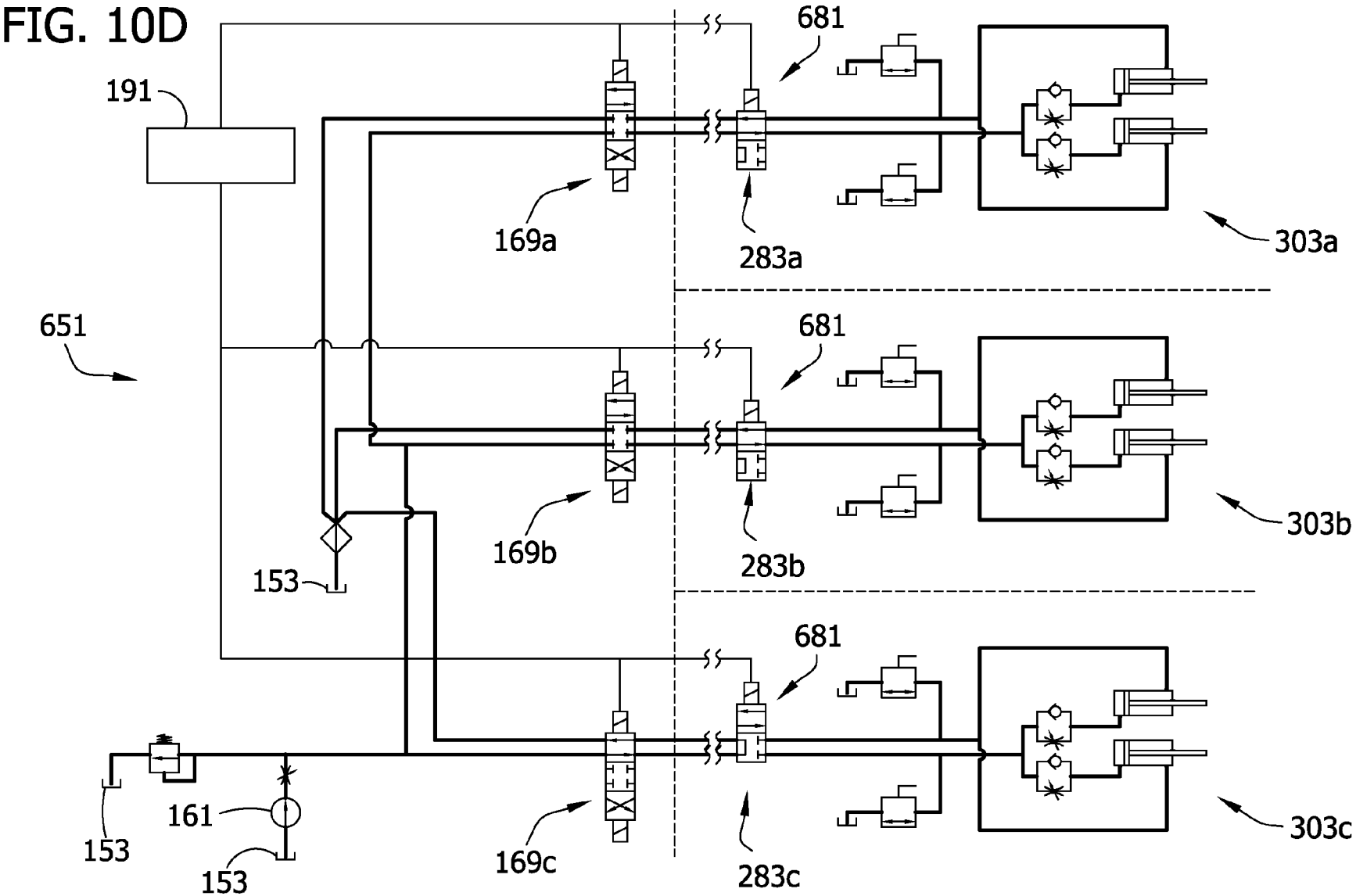

The hydraulic system 651 includes a flushing system 681 that includes the three bypass valves 283*a*, 283*b*, 283*c* in the fluid sub-circuits 303*a*, 303*b*, 303*c*. In one embodiment of the invention, the control system 191 flushes relatively cooler hydraulic fluid 157 from the first fluid sub-circuit 303*a* (e.g., by operating the pump 161 after moving the valves 283*a*-283*c*, 169*a*-169*c* if necessary to arrange them as shown in FIG. 10B), then flushes relatively cooler hydraulic fluid from the second fluid sub-circuit 303*b* g(e.g., by operating the pump after moving the valves to arrange them as shown in FIG. 10C), and then flushes relatively cooler hydraulic fluid from the third fluid sub-circuit 303*c* (e.g., by operating the pump after moving the valves to arrange them as shown in FIG. 10D).

In view of the foregoing, the skilled person will recognize that the present invention provides flexibility to flush any number of fluid sub-circuits by extrapolation of the foregoing systems and methods.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A mine door installation comprising one or more door frames installed in a mine passageway and one or more door leaves mounted on said one or more door frames for movement between open and closed positions of the respective door leaf, movement of said one or more door leaves between its open and closed positions being powered by a hydraulic system, the hydraulic system comprising:

a hydraulic actuator connected to one of said one or more door leaves for driving movement thereof between open and closed positions of the door leaf;

a reservoir having a volume for containing a hydraulic fluid used to operate the hydraulic actuator;

a fluid circuit providing fluid communication between the at least one hydraulic actuator and the reservoir;

a pump operable to pump hydraulic fluid from the reservoir into the fluid circuit; and a fluid circuit flushing system operable to flush hydraulic fluid from the fluid circuit into the reservoir without moving any of the one or more door leaves of the door installation, the fluid circuit flushing system comprising:

a bypass valve moveable between at least one working position in which fluid can be pumped into the fluid circuit to operate the hydraulic actuator and a bypass position in which hydraulic fluid pumped into the fluid circuit flushes hydraulic fluid from the fluid circuit without operating the hydraulic actuator;

a control system operable to move the bypass valve to its bypass position and activate the pump when the bypass valve is in its bypass position to pump hydraulic fluid from the reservoir into the fluid circuit to flush the hydraulic fluid in the fluid circuit into the reservoir; and a first temperature sensor for measuring either an ambient temperature or a temperature of fluid in the fluid circuit, said control system being responsive to a signal from the first temperature sensor to open the bypass valve when the ambient temperature or the temperature of fluid in the fluid circuit is below a specified temperature.

2. The mine door installation as set forth in claim 1, further comprising a heater in the reservoir for heating the hydraulic fluid in the reservoir, and a second temperature sensor for measuring the temperature of the hydraulic fluid in the reservoir.

3. The mine door installation as set forth in claim 1, wherein the fluid circuit flushing system is configured such that either (i) the bypass valve is located no more than about 10 meters from the hydraulic actuator or (ii) the volume of hydraulic fluid that is flushed from the fluid circuit is at least about 80 percent of a total volume of hydraulic fluid contained in the fluid circuit.

4. The mine door installation as set forth in claim 1, wherein the fluid circuit flushing system is configured such that the bypass valve is located no more than about 10 meters from the hydraulic actuator and the volume of hydraulic fluid that is flushed from the fluid circuit is at least about 80 percent of a total volume of hydraulic fluid contained in the fluid circuit.

5. The mine door installation as set forth in claim 1, wherein the first temperature sensor measures ambient temperature.

6. The mine door installation as set forth in claim 1, wherein the bypass valve is at least about 15 meters away from the reservoir.

7. The mine door installation as set forth in claim 1, wherein the first temperature sensor measures the temperature of fluid in the fluid circuit.

8. The mine door installation as set forth in claim 1, wherein the control system has at least one of instructions and circuitry for implementing a fluid circuit flushing routine, the fluid circuit flushing routine comprising moving the bypass valve to its bypass position and operating the pump to pump hydraulic fluid into the fluid circuit while the bypass valve is in its bypass position, the at least one of instructions and circuitry causing the control system to implement the fluid circuit flushing routine only if the temperature measured by the first temperature sensor is below said specified temperature.

9. The mine door installation as set forth in claim 8, further comprising a second temperature sensor operable to output a signal indicative of a temperature of the hydraulic fluid in the reservoir, the fluid circuit flushing routine further comprising beginning a next step in the routine when the temperature of the fluid in the reservoir starts increasing.

10. The mine door installation as set forth in claim 8, wherein the control system further comprises a timer operable to measure an amount of time during which the pump is idle, the fluid circuit flushing routine comprising flushing hydraulic fluid from the fluid circuit after the hydraulic system has been idle for a specified period of time.

11. A hydraulic system for operating a hydraulically powered door installation comprising one or more door frames and or more door leaves mounted on said one or more door frames for movement between open and closed positions of the respective door leaf, the hydraulic system comprising:

a hydraulic actuator for moving one of said one or more door leaves between its open and closed positions;

a reservoir having a volume for containing a hydraulic fluid used to operate the hydraulic actuator;

an electrical resistance heater in thermal communication with the volume of the reservoir for heating the hydraulic fluid in the reservoir;

a fluid circuit providing fluid communication between the at least one hydraulic actuator and the reservoir;

a pump for pumping hydraulic fluid from the reservoir into the fluid circuit; and a fluid circuit flushing system operable to flush hydraulic fluid from the fluid circuit into the reservoir without moving any of the one or more door leaves of the door installation, the fluid circuit flushing system comprising:

a bypass valve moveable between at least one working position in which fluid can be pumped into the fluid circuit to operate the hydraulic actuator and a bypass position in which hydraulic fluid pumped into the fluid circuit flushes hydraulic fluid from the fluid circuit without operating the hydraulic actuator;

a control system operable to move the bypass valve to its bypass position and activate the pump when the bypass valve is in its bypass position to pump hydraulic fluid from the reservoir into the fluid circuit to flush the hydraulic fluid in the fluid circuit into the reservoir; and a first temperature sensor for sensing either an ambient temperature or a temperature of fluid in the fluid circuit, said control system being responsive to a signal from the temperature sensor to open the bypass valve when the ambient temperature or the temperature of fluid in the fluid circuit is below a specified temperature.

12. The hydraulic system as set forth in claim 11, wherein the fluid circuit flushing system comprises a second temperature sensor for measuring the temperature of hydraulic fluid in the reservoir.

13. A hydraulic system for operating a hydraulically powered door installation comprising one or more door frames and or more door leaves mounted on said one or more door frames for movement between open and closed positions of the respective door leaf, the hydraulic system comprising:

a hydraulic actuator for moving one of said one or more door leaves between its open and closed positions;

a reservoir having a volume for containing a hydraulic fluid used to operate the hydraulic actuator;

a heater in thermal communication with the volume of the reservoir for heating the hydraulic fluid in the reservoir;

a fluid circuit providing fluid communication between the at least one hydraulic actuator and the reservoir;

a pump for pumping hydraulic fluid from the reservoir into the fluid circuit; and a fluid circuit flushing system operable to flush a volume of hydraulic fluid from the fluid circuit without moving any of the one or more door leaves of the door installation, the fluid circuit flushing system comprising:

a bypass valve moveable between at least one working position in which fluid can be pumped into the fluid circuit to operate the hydraulic actuator and a bypass position in which hydraulic fluid pumped into the fluid circuit flushes hydraulic fluid from the fluid circuit without operating the hydraulic actuator;

a control system operable to move the bypass valve to its bypass position and activate the pump when the bypass valve is in its bypass position to pump hydraulic fluid from the reservoir into the fluid circuit to flush the hydraulic fluid in the fluid circuit into the reservoir; and the fluid circuit flushing system being configured such that either (i) the bypass valve is located no more than about 10 meters from the hydraulic actuator or (ii) the volume of hydraulic fluid that is flushed from the fluid circuit is at least about 80 percent of a total volume of hydraulic fluid contained in the fluid circuit.

14. The hydraulic system as set forth in claim 13, wherein the fluid circuit flushing system is configured such that the volume of hydraulic fluid that is flushed from the fluid circuit is at least about 80 percent of a total volume of hydraulic fluid contained in the fluid circuit.

15. The hydraulic system as set forth in claim 13, wherein the the fluid circuit flushing system is configured such that the bypass valve is located no more than about 10 meters from the hydraulic actuator and the volume of hydraulic fluid that is flushed from the fluid circuit is at least about 80 percent of a total volume of hydraulic fluid contained in the fluid circuit.

16. A hydraulic system for operating a hydraulically powered door installation comprising two or more door frames and two or more door leaves, a first one of the door leaves being mounted on a first one of the door frames for movement between open and closed positions of the first door leaf, and a second one of the door leaves being mounted on a second one of the door frames for movement between open and closed positions of the second door leaf, the hydraulic system comprising:

a first hydraulic actuator for moving the first door leaf between its open and closed positions;

a second hydraulic actuator for moving the second door leaf between its open and closed positions;

a reservoir having a volume for containing a hydraulic fluid used to operate the first and second hydraulic actuators;

a fluid circuit providing fluid communication between the first and second hydraulic actuators and the reservoir;

a pump for pumping hydraulic fluid from the reservoir into the fluid circuit; and a fluid circuit flushing system operable to flush hydraulic fluid from the fluid circuit into the reservoir without moving any of the two or more door leaves, wherein the fluid circuit comprises first and second fluid sub-circuits, the first fluid sub-circuit being associated with operation of the first hydraulic actuator and not involved with operation of the second hydraulic actuator, the second fluid sub-circuit being associated with operation of the second hydraulic actuator and not involved with operation of the first hydraulic actuator, the fluid circuit flushing system comprising first and second bypass valves in the fluid circuit, the first bypass valve being moveable from a working position in which fluid can be pumped by said pump into the fluid circuit to operate the first hydraulic actuator and a bypass position in which fluid can be pumped into the fluid circuit to flush hydraulic fluid from a portion of the first fluid sub-circuit without moving the first door leaf, the second bypass valve being moveable from a working position in which fluid can be pumped by said pump into the fluid circuit to operate the second hydraulic actuator and a bypass position in which fluid can be pumped into the fluid circuit to flush hydraulic fluid from a portion of the second fluid sub-circuit without moving the second door leaf.

17. The hydraulic system as set forth in claim 16 wherein the fluid circuit flushing system comprises a first temperature sensor for measuring either an ambient temperature or a temperature of fluid in the fluid circuit.

18. The hydraulic system as set forth in claim 17 wherein the fluid circuit flushing system comprises a second temperature sensor for measuring the temperature of hydraulic fluid in the reservoir.

* * * * *